US010911882B2

(12) United States Patent
Mindlin et al.

(10) Patent No.: US 10,911,882 B2
(45) **Date of Patent: *Feb. 2, 2021**

(54) METHODS AND SYSTEMS FOR GENERATING SPATIALIZED AUDIO

(71) Applicant: Verizon Patent and Licensing Inc., Arlington, VA (US)

(72) Inventors: Samuel C. Mindlin, Brooklyn, NY (US); Kunal Jathal, Brooklyn, NY (US); Shan Anis, Jersey City, NJ (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 18 days.

This patent is subject to a terminal disclaimer.

(21) Appl. No.: 16/240,692

(22) Filed: Jan. 4, 2019

(65) Prior Publication Data

US 2019/0208345 A1 Jul. 4, 2019

Related U.S. Application Data

(63) Continuation of application No. 15/856,359, filed on Dec. 28, 2017, now Pat. No. 10,206,055.

(51) Int. Cl.
*H04S 5/00* (2006.01)
*H04S 7/00* (2006.01)
(Continued)

(52) U.S. Cl.
CPC ..... *H04S 5/005* (2013.01); *G08B 6/00* (2013.01); *H04R 5/033* (2013.01); *H04R 5/04* (2013.01);
(Continued)

(58) Field of Classification Search
CPC ..... H04M 3/568; H04M 3/567; H04M 9/082; H04M 9/003; H04M 9/085; H04M 7/006; H04M 7/12; H04R 2420/07; H04R 5/04; H04R 5/00; H04R 5/033; H04R 1/1083; H04R 2225/023; H04R 2225/41; H04R 2227/003; H04R 2227/005; H04R 2430/01; H04R 2499/13; H04R 25/453; H04R 27/00; H04R 29/007; H04R 5/02; H04R 25/30; H04S 2400/11; H04S 1/005; H04S 5/00; H04S 7/302; H04S 2420/01; H04S 1/002; H04S 2400/07; H04S 2420/07;
(Continued)

(56) References Cited

U.S. PATENT DOCUMENTS 6,329,986 B1 * 12/2001 Cheng ..... G06F 3/011 345/419
10,206,055 B1 * 2/2019 Mindlin ..... H04S 7/304
(Continued)

*Primary Examiner* — Lun-See Lao

(57) ABSTRACT

A spatialized audio presentation system selects, based on an orientation of an avatar with respect to a virtual sound source, a head-related impulse response from a library of head-related impulse responses corresponding to different potential orientations of the avatar with respect to the virtual sound source. The spatialized audio presentation system applies the selected head-related impulse response to a sound that is generated by the virtual sound source and is to be presented to a user associated with the avatar. Additionally, the spatialized audio presentation system applies an additional effect to the sound that is to be presented to the user. Corresponding methods and systems are also disclosed.

20 Claims, 14 Drawing Sheets

(51) Int. Cl.

| | |
|---|---|
| ***H04S 3/00*** | (2006.01) |
| ***G08B 6/00*** | (2006.01) |
| ***H04R 5/033*** | (2006.01) |
| ***H04R 5/04*** | (2006.01) |

(52) U.S. Cl.
CPC ..... *H04S 3/008* (2013.01); *H04S 7/304* (2013.01); *H04S 2400/01* (2013.01); *H04S 2400/11* (2013.01); *H04S 2400/13* (2013.01); *H04S 2420/01* (2013.01)

(58) Field of Classification Search
CPC ..... H04S 7/40; H04S 7/303; H04S 2420/03; H04S 2420/11; H04S 2400/15; H04S 7/30; H04S 7/305; G10L 19/018; G10L 21/10; G10L 19/00; G10L 12/1813; H04N 13/271; H04N 7/142; H04N 7/144; H04N 7/157
USPC ..... 381/1, 300, 310, 17–22, 54–58, 74, 77, 381/61, 103–105, 110; 700/94
See application file for complete search history.

(56) References Cited

U.S. PATENT DOCUMENTS

| | | | | |
|---|---|---|---|---|
| 10,672,417 | B2 * | 6/2020 | Scholar | G10L 15/063 |
| 2009/0238378 | A1 | 9/2009 | Kikinis et al. | |
| 2011/0069841 | A1 | 3/2011 | Angeloff et al. | |
| 2011/0255702 | A1 * | 10/2011 | Jensen | H04R 25/554 381/66 |
| 2013/0041648 | A1 | 2/2013 | Osman | |
| 2013/0208926 | A1 | 8/2013 | Vincent et al. | |
| 2013/0236040 | A1 * | 9/2013 | Crawford | H04S 7/306 381/310 |
| 2017/0094440 | A1 * | 3/2017 | Brown | H04S 7/30 |
| 2017/0359467 | A1 | 12/2017 | Norris et al. | |
| 2018/0343534 | A1 * | 11/2018 | Norris | H04N 5/232 |

* cited by examiner

700

| LIBRARY OF HEAD-RELATED IMPULSE RESPONSES | | | |
|---|---|---|---|
| INDEXING | | IMPULSE RESPONSE DATA | |
| Azimuth_Angle_01 | Elevation_Angle_01 | Left Component 1 | Right Component 1 |
| Azimuth_Angle_01 | Elevation_Angle_02 | Left Component 2 | Right Component 2 |
| Azimuth_Angle_01 | Elevation_Angle_03 | Left Component 3 | Right Component 3 |
| Azimuth_Angle_01 | Elevation_Angle_04 | Left Component 4 | Right Component 4 |
| Azimuth_Angle_02 | Elevation_Angle_01 | Left Component 5 | Right Component 5 |
| Azimuth_Angle_02 | Elevation_Angle_02 | Left Component 6 | Right Component 6 |
| Azimuth_Angle_02 | Elevation_Angle_03 | Left Component 7 | Right Component 7 |
| Azimuth_Angle_02 | Elevation_Angle_04 | Left Component 8 | Right Component 8 |
| Azimuth_Angle_03 | Elevation_Angle_01 | Left Component 9 | Right Component 9 |
| Azimuth_Angle_03 | Elevation_Angle_02 | Left Component 10 | Right Component 10 |
| Azimuth_Angle_03 | Elevation_Angle_03 | Left Component 11 | Right Component 11 |
| Azimuth_Angle_03 | Elevation_Angle_04 | Left Component 12 | Right Component 12 |
| . . . | . . . | . . . | . . . |
| Azimuth_Angle_N | Elevation_Angle_04 | Left Component M | Right Component M |

Fig. 7

METHODS AND SYSTEMS FOR GENERATING SPATIALIZED AUDIO

RELATED APPLICATIONS

This application is a continuation application of U.S. patent application Ser. No. 15/856,359, filed Dec. 28, 2017, and entitled "Methods and Systems for Generating Spatialized Audio During a Virtual Experience," which is hereby incorporated by reference in its entirety.

BACKGROUND INFORMATION

Users of media player devices (e.g., virtual reality headsets, mobile devices, game consoles, computing devices, augmented reality glasses, etc.) may experience virtual worlds using the media player devices. For example, a media player device may render video of what a user would see and audio of what the user would hear if the user were actually present in a virtual world being presented.

In certain virtual worlds, different users may be able to jointly experience the same world simultaneously. In these examples, the different users may be able to communicate with one another by way of a basic intercommunication system. For example, a first user experiencing a virtual world from one location may speak into a microphone (e.g., a microphone integrated into his or her media player device) that captures his or her voice as an audio signal. That audio signal may then be transmitted and presented to other users at other locations who are simultaneously experiencing the virtual world with the first user. The other users may respond so as to be heard by one another and by the first user in like manner.

While such communication may be convenient and useful to users experiencing a virtual world together, the intercom-like nature of such communication may detract from the realism or immersiveness of the virtual experience. For example, because an audio signal presented to a first user of what a second user spoke may be a monaural capture of the second user's voice that is played back directly into the first user's headset, the first user may perceive that he or she is hearing the second user over an intercom system rather than naturally speaking to the user in person as the video content of the virtual experience may be intended to suggest.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

FIG. 7 illustrates an exemplary library of head-related impulse responses from which a head-related impulse response may be selected according to principles described herein.

DETAILED DESCRIPTION OF PREFERRED EMBODIMENTS

Figure 1:
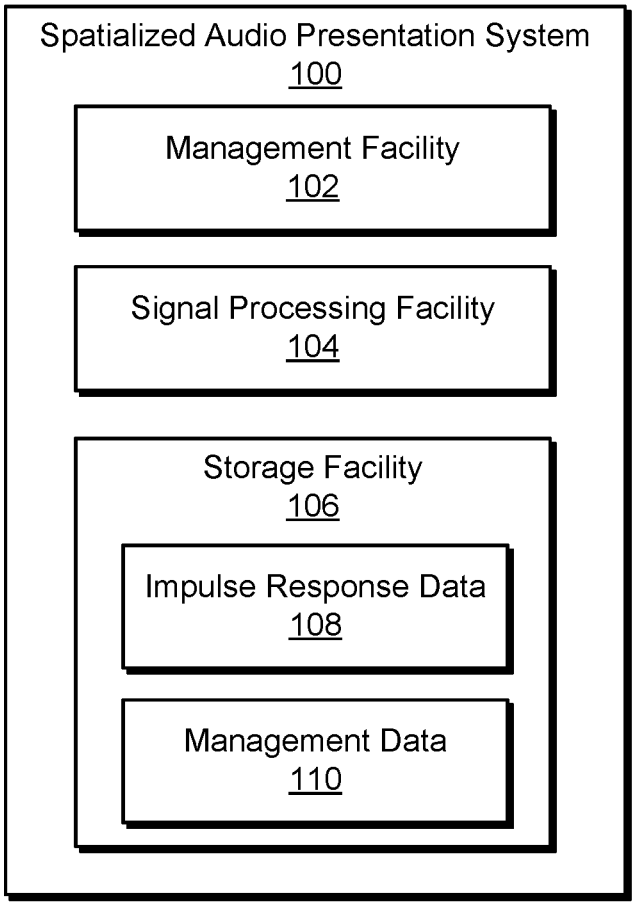
FIG. 1 illustrates an exemplary spatialized audio presentation system for spatialized audio presentation during a virtual experience according to principles described herein.

Systems and methods for spatialized audio presentation during a virtual experience are described herein. As used herein, a "spatialized audio presentation" refers to an audio presentation in which audio is presented (e.g., prepared and delivered, rendered, played back, and/or otherwise presented) to a user of a media player device in such a way that the audio is perceived by the user as originating at a particular location in space (e.g., within a virtual space such as an immersive virtual reality space distinct from the physical real-world space surrounding the user during a virtual reality experience, or such as the physical real-world space surrounding the user during an augmented reality experience).

As will be described in more detail below, a spatialized audio presentation may involve presenting slightly different versions of a sound to each ear of the user to emulate interaural time differences, interaural level differences, and/or other cues used by humans to identify a location from which sounds originate in space. Along with implementing these cues, additional effects may also be applied to sounds presented as part of a spatialized audio presentation. For example, as will be described in more detail below, reverberation effects may be applied to the sound to simulate a virtual space in which the sound virtually originates, occlusion effects may be applied to the sound to simulate objects (e.g., virtual objects or real objects) within the virtual space partially blocking the sound from traveling through the virtual space, source projection effects may be applied to the sound to simulate aspects of how the sound source virtually projects the sound within the virtual space, and so forth.

As used herein, "virtual spaces," "virtual experiences" within those virtual spaces, "virtual media content" representative of such virtual spaces, and so forth, may refer to virtual reality technologies, augmented reality technologies, mixed reality technologies, and/or any other suitable technologies in which at least some virtual elements are presented to users in a way that mimics reality. For instance, various examples described herein relate specifically to virtual reality technologies in which virtual spaces include immersive virtual reality spaces that are different from physical real-world spaces surrounding users during virtual reality experiences provided by way of virtual reality media content. However, it will be understood that principles illustrated by such examples may apply in a similar way to augmented reality technologies and/or other suitable technologies. For instance, in an augmented reality example, a virtual space may be the same as the physical real-world space surrounding a user during an augmented reality experience (e.g., because virtual objects and elements are presented within the physical real-world space along with real-world objects and elements).

A spatialized audio presentation system may perform a spatialized audio presentation during a virtual experience in any suitable way. For example, for a virtual avatar of a user engaged in a virtual experience within a virtual space, an exemplary implementation of a spatialized audio presentation system may identify an orientation of the virtual avatar with respect to a virtual sound source that is located within the virtual space and that generates a sound to be presented to the user while the user is engaged in the virtual experience. For instance, in a virtual space implemented by an immersive virtual reality space (e.g., a space distinct from the physical real-world space surrounding the user during the virtual reality experience), the virtual avatar may be a virtual version of the user that exists and represents the user within the immersive virtual reality space, while the virtual sound source may be another avatar of a different user who is communicating with the user or another suitable virtual sound source within the virtual reality space. As another example, in a virtual space implemented as an augmented reality space (i.e., the physical real-world space surrounding the user during the augmented reality experience), the user himself or herself may act as the virtual avatar in the augmented reality space implemented as the physical real-world space surrounding the user, and the virtual sound source may be a virtual character or other suitable sound source being presented in the augmented reality space.

Based on the identified orientation of the virtual avatar with respect to the virtual sound source, the spatialized audio presentation system may select a head-related impulse response from a library of head-related impulse responses corresponding to different potential orientations of the virtual avatar with respect to the virtual sound source. For example, the selected head-related impulse response may correspond to the identified orientation and may include a left-side component and a right-side component specifically associated with the identified orientation. Accordingly, the spatialized audio presentation system may generate a left-side version of the sound for presentation to the user at a left ear of the user while the user is engaged in the virtual experience. For example, the left-side version of the sound may be generated by applying the left-side component of the selected head-related impulse response to the sound. Similarly, the spatialized audio presentation system may generate a right-side version of the sound for presentation to the user at a right ear of the user while the user is engaged in the virtual experience. For example, the right-side version of the sound may be generated by applying the right-side component of the selected head-related impulse response to the sound.

In the same or other exemplary implementations, a spatialized audio presentation system may perform spatialized audio presentation operations during a virtual experience to dynamically and continuously present audio in a spatialized fashion even as the user moves the virtual avatar within the virtual space, as the virtual sound source moves within the virtual space, and/or as the orientation of the virtual avatar with respect to the virtual sound source otherwise changes over time. For example, the spatialized audio presentation system may perform such spatialized audio presentation operations in real time. As used herein, operations are performed "in real time" when performed immediately and without undue delay. Thus, because operations cannot be performed instantaneously, it will be understood that a certain amount of delay (e.g., a few milliseconds up to a few seconds) may accompany any real-time operation. However, if operations are performed immediately such that, for example, spatialization aspects of the audio are updated while the audio is being presented (albeit with a slight delay), such operations will be considered to be performed in real time.

In certain implementations (e.g., real-time implementations), for example, a spatialized audio presentation system may identify a first orientation, at a first point in time, of a virtual avatar of a user engaged in a virtual experience within a virtual space with respect to a virtual sound source that is also located within the virtual space. The virtual sound source may generate a sound to be presented to the user while the user is engaged in the virtual experience. Based on the first orientation, the spatialized audio presentation system may select a first head-related impulse response from a library of head-related impulse responses corresponding to different potential orientations of the virtual avatar with respect to the virtual sound source. The first head-related impulse response may include a left-side component and a right-side component, such that the spatialized audio presentation system may then generate a left-side version and a right-side version of the sound (e.g., for presentation to the user, respectively, at a left ear of the user and at a right ear of the user while the user is engaged in the virtual experience) by applying, respectively, the left-side and right-side components of the first head-related impulse response to the sound.

At a second point in time subsequent to the first point in time, the spatialized audio presentation system may identify a second orientation of the virtual avatar with respect to the virtual sound source. For example, the virtual avatar and/or the virtual sound source may have moved or rotated relative to one another to thereby change the respective orientation.

As such, the spatialized audio presentation system may select, based on the second identified orientation, a second head-related impulse response from the library of head-related impulse responses. For example, the second head-related impulse response may correspond to the second orientation and may include a left-side component and a right-side component. The spatialized audio presentation system may update the left-side version of the sound by cross-fading the application of the left-side component of the first head-related impulse response to an application of the left-side component of the second head-related impulse response to the sound. Similarly, the spatialized audio presentation system may also update the right-side version of the sound by cross-fading the application of the right-side component of the first head-related impulse response to an application of the right-side component of the second head-related impulse response to the sound.

Methods and systems for spatialized audio presentation during a virtual experience may provide various benefits to users engaging in virtual experiences. For example, disclosed methods and systems may allow users to perceive sounds (e.g., including spoken communications from other users) in a spatialized manner as if the sounds actually originated from sound sources disposed at locations within a physical space that are analogous to the virtual locations of the virtual sound sources within the virtual space. For instance, if a first user is listening to a second user virtually located a few feet away on the first user's right-hand side within a virtual space, the first user may perceive the second user's speech as if it originated from a few feet away on the first user's right-hand side within a physical room similar to the virtual space, rather than perceiving the speech as if it were spoken over an intercom system or the like. As a result, audio presented to users within virtual experiences may seem more realistic, making the virtual experience significantly more immersive, natural, and enjoyable to the users.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary spatialized audio presentation system 100 ("system 100") for spatialized audio presentation during a virtual experience. In particular, as will be described and illustrated in more detail below, system 100 may prepare different versions of a sound for presentation at different ears of a user to simulate how the sound would be perceived if the sound actually originated under the circumstances with which the sound appears to the user to originate within a virtual space. As shown, system 100 may include, without limitation, a management facility 102, a signal processing facility 104, and a storage facility 106 selectively and communicatively coupled to one another. It will be recognized that although facilities 102 through 106 are shown to be separate facilities in FIG. 1, facilities 102 through 106 may be combined into fewer facilities, such as into a single facility, or divided into more facilities as may serve a particular implementation. Each of facilities 102 through 106 may be distributed between multiple devices (e.g., including suitable server-side devices and/or client-side devices) and/or multiple locations as may serve a particular implementation. Additionally, one or more of facilities 102 through 106 may be omitted from system 100 in certain implementations, while additional facilities may be included within system 100 in the same or other implementations. Each of facilities 102 through 106 will now be described in more detail.

Management facility 102 may include any hardware and/or software (e.g., network interfaces, computing devices, software running on or implementing such devices or interfaces, etc.) that may be configured to perform management operations for spatialized audio presentation during a virtual experience as described herein. For example, management facility 102 may identify, for a virtual avatar of a user engaged in a virtual experience within a virtual space, an orientation of the virtual avatar with respect to a virtual sound source that is located within the virtual space and that generates a sound to be presented to the user while the user is engaged in the virtual experience. The virtual sound source may include any avatar, character, inanimate virtual object, or other aspect or component included in a virtual space from which sound appears to originate. For example, an avatar of another user may be said to "generate a sound" to be presented to the user while the user is located within the virtual space when the other user speaks words for the avatar of the other user to speak within the virtual space. In other examples, other characters (e.g., characters that are not avatars of users experiencing the virtual space) or other objects may similarly generate sounds such as speech, Foley sounds, sound effects, and/or any other suitable sounds to be presented to the user within the virtual space.

To this end, management facility 102 may capture, receive, download, and/or otherwise access audio signals representative of the sounds generated by the virtual sound source within the virtual space (i.e., sounds to be presented to the user while the user is engaged in the virtual experience). For example, management facility 102 may access an audio signal from any suitable source including, for example, a headset microphone of a media player device of another user who wishes to communicate with the user, one or more microphones disposed within a capture zone of a real-world scene upon which the virtual space is based, another facility of system 100, another system communicatively coupled with system 100, or the like.

Based on the identified orientation of the virtual avatar with respect to the virtual sound source (e.g., including an azimuth angle, elevation angle, etc. between the virtual avatar and the virtual sound source as will be described in more detail below), management facility 102 may select a head-related impulse response from a library of head-related impulse responses corresponding to different potential orientations of the virtual avatar with respect to the virtual sound source. For example, the selected head-related impulse response may correspond to the identified orientation and may include a left-side component and a right-side component. Management facility 102 may then provide the accessed audio signal representative of the sound, the identified orientation, the selected head-related impulse response, and/or other information to signal processing facility 104 to be used in generating a spatialized audio representation of the sound.

Signal processing facility 104 may include one or more physical computing devices (e.g., the same hardware and/or software components included within management facility 102 and/or components separate from those of management facility 102) that perform various signal processing operations for generating a spatialized audio representation of the sound accessed by management facility 102 for the identified orientation based on the selected head-related impulse response. For example, signal processing facility 104 may generate a left-side version of the sound for presentation to the user at a left ear of the user and a right-side version of the sound for presentation to the user at a right ear of the user while the user is engaged in the virtual experience. Specifically, signal processing facility 104 may generate the left-side and right-side versions of the sound by applying the left-side component of the selected head-related impulse response to the sound, and by applying the right-side component of the selected head-related impulse response to the sound, respectively.

As the left-side and right-side versions of the sound are being generated in this manner (e.g., in real time as the sound continues to stream in), or, in certain examples, after the left-side and right-side versions of the sound have been generated, system 100 may present the left-side and right-side versions of the sound to the user at the respective ears of the user. As used herein, system 100 may "present" sound to a user by rendering or playing back the sound directly to the user's ears (e.g., by way of a loudspeaker built into a headset or the like), or by preparing and delivering data representative of the sound for rendering by other devices (e.g., a media player device being used by the user).

Storage facility 106 may include impulse response data 108, management data 110, and/or any other data received, generated, managed, maintained, used, and/or transmitted by facilities 102 and 104. Impulse response data 108 may include the library of head-related impulse responses mentioned above from which the head-related impulse response corresponding to the identified orientation of the virtual avatar with respect to the virtual sound source is selected. Management data 110 may include data used to facilitate operations of facilities 102 and/or 104 such as buffering spaces for storing sounds generated by virtual sound sources within the virtual space; program code, variables, and intermediate signals used in the generation of the different versions of the sound; and/or any other signals or data used to implement methods and systems described herein as may serve a particular implementation.

Figure 2:
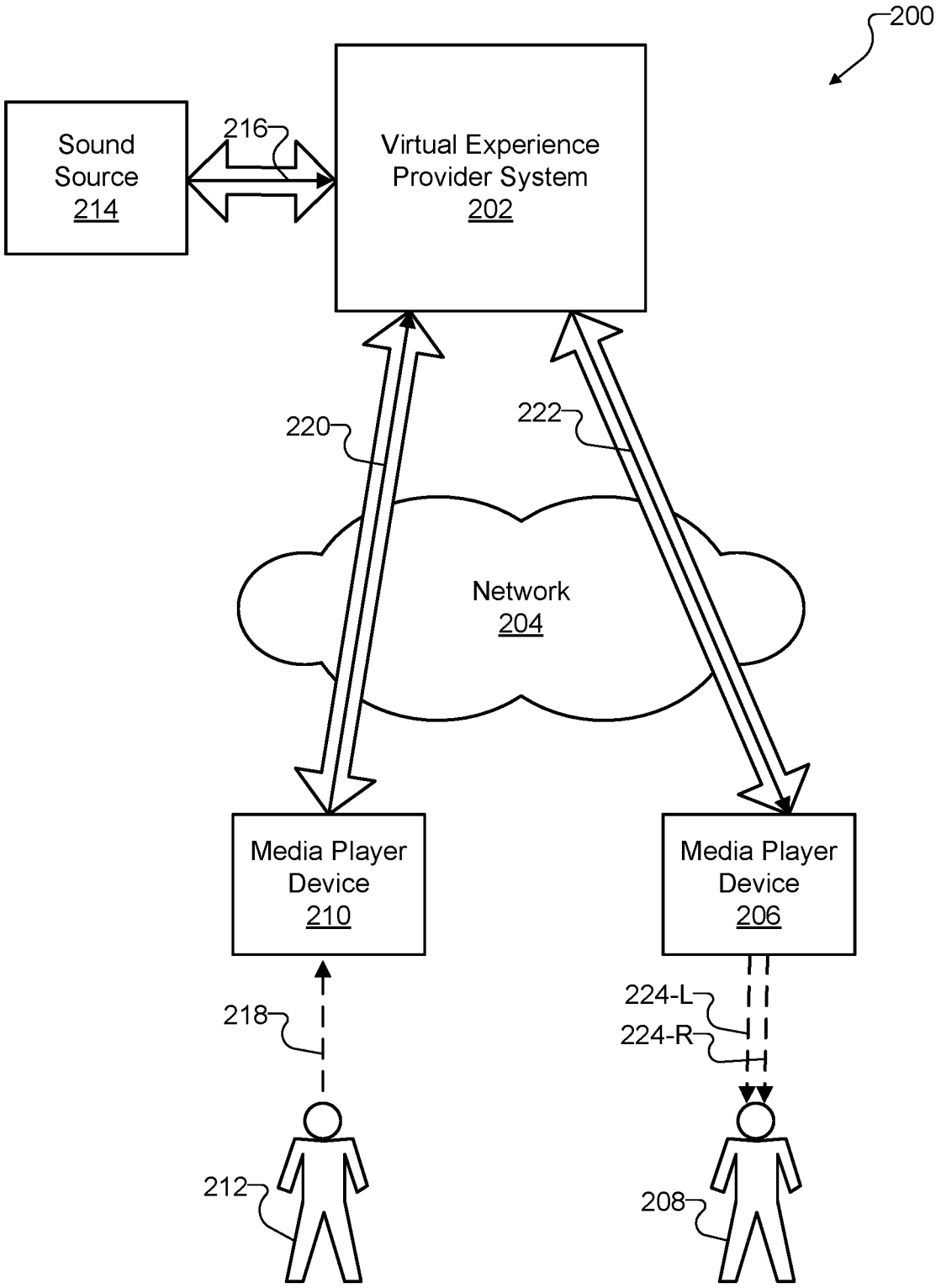
FIG. 2 illustrates an exemplary configuration in which the spatialized audio presentation system of FIG. 1 operates to provide a spatialized audio presentation during a virtual experience according to principles described herein.

To illustrate system 100 in operation, FIG. 2 shows an exemplary configuration 200 in which system 100 operates to provide a spatialized audio presentation during a virtual experience. As shown in FIG. 2, a virtual experience provider system 202 is communicatively coupled, by way of a network 204, with a first media player device 206 associated with a user 208, and with a second media player device 210 associated with a user 212 (illustrated by bidirectional block arrows). Additionally, a sound source 214 is shown as being communicatively coupled to virtual experience provider system 202.

Virtual experience provider system 202 may include one or more computing devices (e.g., server computers, database storage centers, etc.) responsible for capturing, accessing, generating, distributing, and/or otherwise providing and curating virtual media content (e.g., virtual reality media content, augmented reality media content, etc.) to be delivered to media player devices such as media player devices 206 and 210. As such, virtual experience provider system 202 may generate and/or access (e.g., from a virtual content creation system) virtual media content data representative of image data and/or audio data. Virtual experience provider system 202 may also process, prepare, and deliver this data in a form that may be used by media player devices 206 and 210 to provide virtual experiences for users 208 and 212, respectively.

Network 204 may provide data delivery means between server-side systems such as virtual experience provider system 202 and client-side systems such as media player devices 206 and 210 in a server-client data delivery architecture such as implemented by configuration 200. As such, network 204 may include a provider-specific wired or wireless network (e.g., a cable or satellite carrier network or a mobile telephone network), the Internet, a wide area network, a content delivery network, and/or any other suitable network or networks, and virtual media content data may be distributed using any suitable communication technologies included within network 204. Data may flow between virtual experience provider system 202 and media player devices 206 and/or 210 using any communication technologies, devices, media, and protocols as may serve a particular implementation.

Media player devices 206 and 210 may be configured to present virtual media content generated and provided by virtual experience provider system 202 to users 208 and 212, respectively. Media player device 212 may take any of various forms including a head-mounted virtual media content device (e.g., a virtual reality gaming device, a set of augmented reality glasses, etc.), a mobile or wireless device (e.g., a smartphone, a tablet device, etc.), or any other device or configuration of devices that may serve a particular implementation to facilitate receiving and/or presenting virtual media content to a user.

In operation, the devices and systems of configuration 200 may present a sound (i.e., audio data representative of an acoustic sound that may be captured by a microphone and/or rendered by a loudspeaker) to either or both of users 208 and 212 that is generated by a virtual sound source within a virtual space that the users are experiencing.

For instance, as one example, the virtual sound source may be a virtual object or character within the virtual space and the sound may be a sound effect or other sound generated by the sound source (e.g., Foley sounds such as footsteps, etc.). Such sounds may be synthesized, prerecorded, captured from a real-world scene in real time, or generated in any other manner as may serve a particular implementation. For example, as shown, sound source 214 may generate and transmit a sound 216 to virtual experience provider system 202 that may be incorporated into virtual media content generated by virtual experience provider system 202 and provided to media player devices 206 and 210.

As another example, the virtual sound source may be a virtual avatar of user 212 within the virtual space and the sound may be a voice communication 218 spoken by user 212 to be heard by user 208 while both users are engaged in a virtual experience together. For example, voice communication 218 may be captured by a microphone associated with media player device 210 (e.g., a microphone integrated into a headset worn by user 212, one or more microphones placed around user 212, etc.) and transmitted to virtual experience provider system 202 as a sound 220 that is to be associated with (e.g., made to appear to be spoken by) a virtual avatar of user 212 within the virtual space presented by virtual experience provider system 202.

Figure 3:
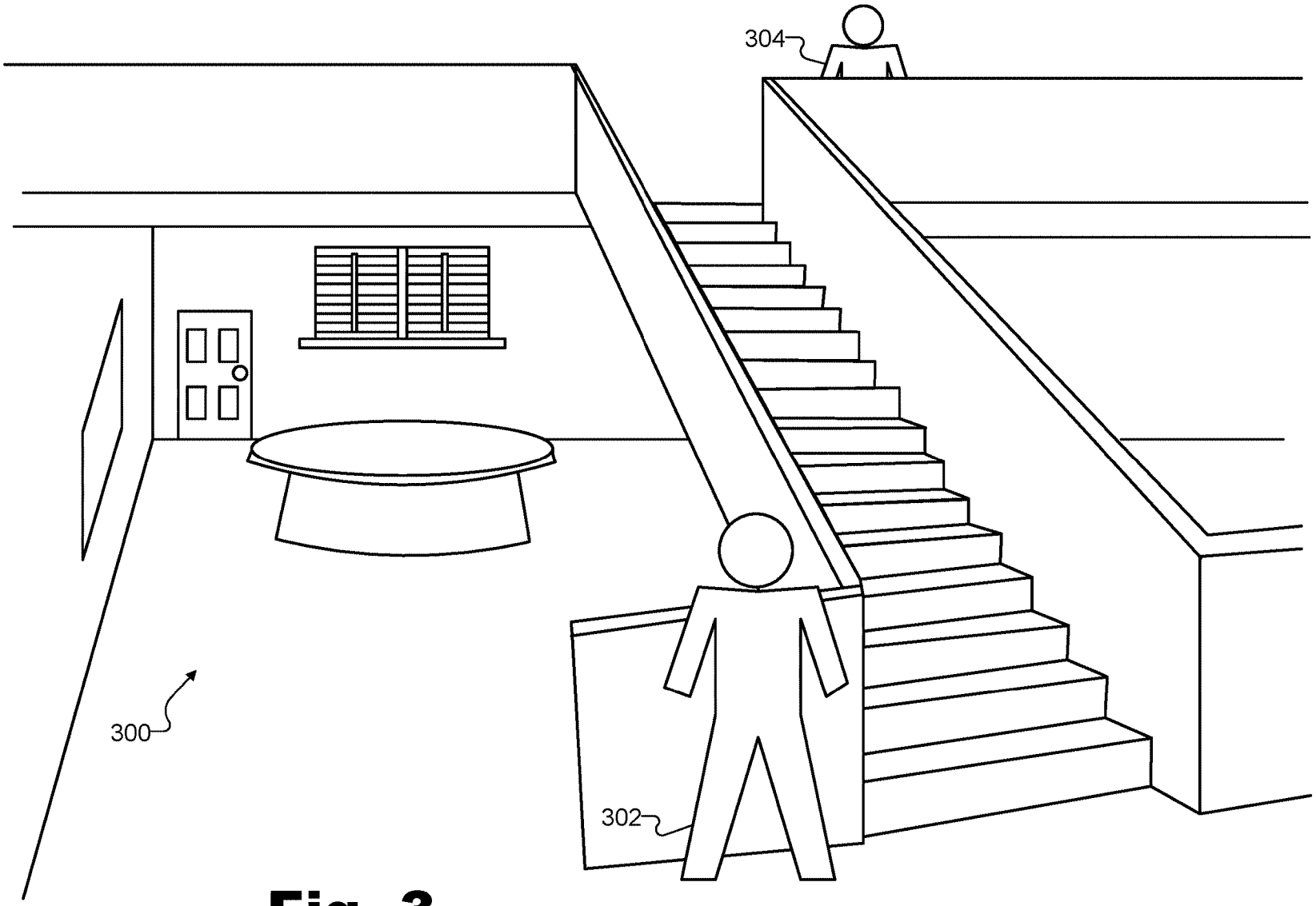
FIG. 3 illustrates a perspective view of an exemplary virtual space in which multiple users share a virtual experience together according to principles described herein.

FIG. 3 illustrates this scenario where user 212 communicates with user 208 while both are engaged in a mutual virtual experience. Specifically, FIG. 3 shows a perspective view of an exemplary virtual space 300 in which users 208 and 212 share a virtual experience together. As shown, virtual space 300 may include a room including various objects (e.g., walls, a floor, a ceiling, a table, a staircase, etc.) and in which a virtual avatar 302 and a virtual avatar 304 may each be located. Virtual avatar 302 may be a virtual avatar of user 208 while virtual avatar 304 may be a virtual avatar of user 212.

Virtual space 300 and the objects and other components included therein may be generated in any way and based on any scenery or objects as may serve a particular implementation. For example, virtual space 300 may be based on a live (e.g., real-time) feed of camera-captured scenery of a real-world scene. As another example, virtual space 300 may be based on camera-captured scenery of a real-world scene captured previously, or a completely virtualized (e.g., animated) world that is not based on camera-captured scenery but, rather, is entirely computer generated.

Users 208 and 212 may view and interact with various objects included in virtual space 300 by way of their respective virtual avatars 302 and 304 as the users experience virtual space 300. For example, user 208 may cause virtual avatar 302 to walk into the room including the table, windows and door, or to walk up the staircase to join avatar 304 at the top of the stairs. Similarly, user 212 may cause avatar 304 to move to similar locations within virtual space 300. As users 208 and/or 212 thus cause virtual avatars 302 and 304 to move through virtual space 300 and/or as users 208 and/or 212 speak to one another during the shared virtual experience in virtual space 300, it may be desirable for each user to hear sounds (e.g., footsteps, spoken communications, etc.) as they would sound if the users were actually co-located in a real-world space like virtual space 300 rather than, for example, in separate locations each experiencing virtual space 300 by way of respective media player devices.

To this end, as described above, system 100 may, for each user, identify the orientation of the user's virtual avatar and a particular sound source making a particular sound (e.g., the virtual avatar of the other user as the other user is speaking), select an appropriate head-related impulse response corresponding to the identified orientation, and generate left-side and right-side versions of the particular sound to present to the user by applying the selected head-related impulse response. As such, system 100 may be implemented in various ways to perform such operations.

For example, returning to FIG. 2 and the specific example in which user 212 is providing voice communication 218 to be presented to user 208, an exemplary implementation of system 100 for presenting spatialized audio to user 208 may be implemented in virtual experience provider system 202, in media player device 206, across a combination of virtual experience provider system 202 and media player device 206, and/or in any other suitable manner. If system 100 is implemented within virtual experience provider system 202, for instance, virtual experience provider system 202 may communicate with media player devices 206 and 210 to track dynamic location changes for both virtual avatars 302 and 304, and, based on the tracked locations of the virtual avatars, identify the orientation (e.g., angles) of the virtual avatars with respect to one another. In this type of implementation, virtual experience provider system 202 may also maintain a library of head-related impulse responses such that virtual experience provider system 202 may select an appropriate head-related impulse response from the library and generate the left-side and right-side versions of the sounds, which virtual experience provider system 202 may present to user 208 by transmitting the versions to media player device 206 as a spatialized audio signal represented by a transmission arrow 222 in configuration 200.

As another exemplary implementation of system 100 configured to present spatialized audio to user 208, system 100 may be implemented within media player device 206. In this case, virtual experience provider system 202 may provide updated data representative of the location of virtual avatar 304, which media player device 206 may compare with the location of virtual avatar 302 tracked directly from movements of user 208. Based on the respective locations of the virtual avatars, media player device 206 may identify the orientation of virtual avatar 302 with respect to virtual avatar 304 and select a corresponding head-related impulse response (e.g., based on the identified orientation) from a library of head-related impulse responses maintained in a storage facility of media player device 206. In this scenario, transmission arrow 222 may thus represent a monaural version of the sound (e.g., similar or identical to sound 220), and media player device 206 may generate a left-side version 224-L and a right-side version 224-R of the sound received from virtual experience provider system 202. Media player device 206 may present versions 224-L and 224-R of the sound to user 208 by rendering left-side version 224-L for the left ear of user 208 and right-side version 224-R for the right ear of user 208.

It will be understood that in this type of implementation, system 100 may only serve user 208 and a separate implementation of system 100 (e.g., implemented on media player device 210) may be used to present spatialized audio to user 212 in a similar way. In contrast, the implementation of system 100 implemented within virtual experience provider system 202 described above may be configured to serve multiple media player devices such as media player devices 206, 210, and other media player devices not explicitly shown in FIG. 2.

Regardless of how system 100 is implemented with respect to configuration 200, in the example described above where user 212 speaks to user 208 during the shared experience in virtual space 300, system 100 may identify an orientation of virtual avatar 302 with respect to virtual avatar 304 (i.e., the virtual sound source generating the sound in this example). For example, referring again to FIG. 3, virtual avatar 304 may be positioned at a particular azimuth angle and a particular elevation angle with respect to a direction in which virtual avatar 302 is facing (e.g., the direction avatar 302 is looking, or, more particularly, the direction that virtual ears of virtual avatar 302 are directed). Thus, for instance, if virtual avatar 302 is facing the back wall of virtual space 300 (i.e., approximately facing the window, the table, etc.), virtual avatar 304 may be identified to be at an azimuth angle a few degrees to the right and at an elevation angle several degrees above where virtual avatar 302 is facing.

Figure 4:
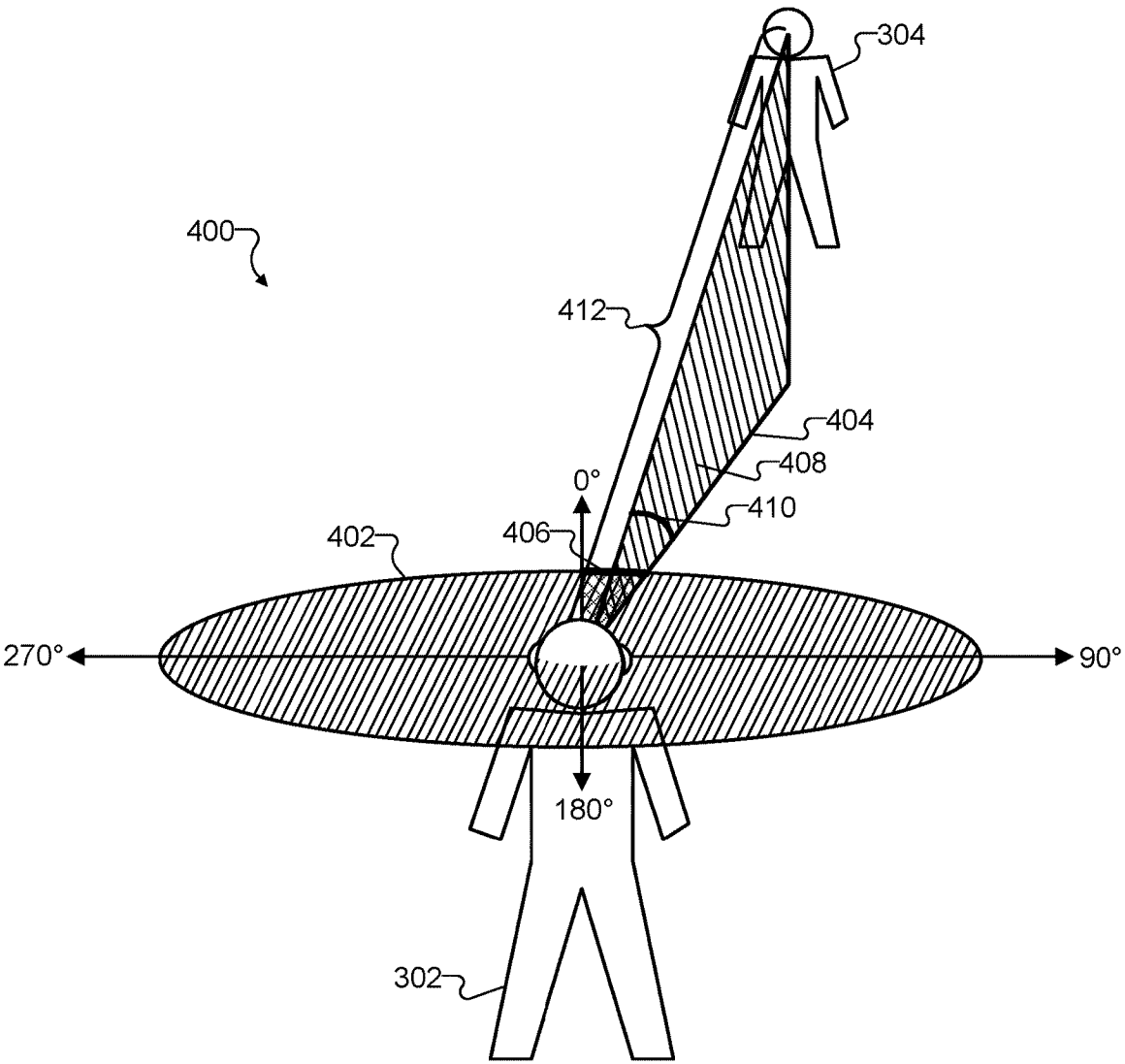
FIG. 4 illustrates exemplary aspects of an orientation of a virtual avatar with respect to a virtual sound source located in the same virtual space according to principles described herein.

To illustrate, FIG. 4 shows exemplary aspects of an orientation 400 of virtual avatar 302 with respect to virtual avatar 304 in the example where virtual avatar 304 is a virtual sound source located in the same virtual space and generating a sound (e.g., a spoken communication) for presentation to user 208, who is associated with virtual avatar 302. In FIG. 4, virtual avatars 302 and 304 are located in the same respective locations within virtual space 300 as shown in FIG. 3. However, in order to better illustrate orientation 400, other objects within virtual space 300 (e.g., the walls, staircase, table, etc.) are omitted from FIG. 4.

As used herein, an orientation of a virtual avatar with respect to a virtual sound source may refer to an azimuth angle between a line of sight of the virtual avatar and the virtual sound source on a horizontal plane associated with the virtual avatar, to an elevation angle between the horizontal plane and the virtual sound source on a vertical plane perpendicular to the horizontal plane, and/or to any other information relevant to the spatial relationship between the virtual avatar and the virtual sound source as may serve a particular implementation.

Accordingly, orientation 400 illustrated in FIG. 4 is depicted by way of a horizontal plane 402 associated with virtual avatar 302. For example, as shown horizontal plane 402 may be an imaginary plane connecting both ears of virtual avatar 302 and, for example, a forward line of sight of virtual avatar 302 (i.e., the direction directly in front of virtual avatar 302. The forward line of sight of virtual avatar 302 on horizontal plane may correspond to a reference angle of 0°, as shown. Then, regardless of elevation, every object around virtual avatar 302 may be at a particular azimuth angle with respect to the reference. For example, an object directly in front of a direction in which virtual avatar 302 is facing may have an azimuth angle of 0°, while an object such as virtual avatar 304, which is at a horizontal vector 404, may have an azimuth angle 406 (e.g., approximately 15° in this example). Every object around virtual avatar 302 may also be at a particular elevation angle with respect to horizontal plane 402 on a vertical plane that includes the horizontal vector for the object and is orthogonal to horizontal plane 402. For example, as shown, a portion of a vertical plane 408 that is orthogonal to horizontal plane 402 and includes horizontal vector 404 (and, thus, also includes virtual avatar 304) illustrates an elevation angle 410 from horizontal plane vector 404 to virtual avatar 304 (e.g., to the mouth of virtual avatar 304, in particular, since the voice communication sound originates there).

Accordingly, orientation 400 of virtual avatar 302 with respect to virtual avatar 304 may refer to a combination of both azimuth angle 406 and elevation angle 410. Additionally, in certain examples, orientation 400 may further refer to or be associated with other information relevant to the spatial relationship between virtual avatars 302 and 304. For example, system 100 may identify a distance 412 from virtual avatar 302 to the virtual sound source of virtual avatar 304. Distance 412 may be relevant to the spatial relationship between the virtual avatars because distance 412 may affect how sound would propagate between the virtual avatars and how the sound should be perceived by the virtual avatars. Thus, as will be described below, orientation 400 may include or be associated with distance 412.

As will be described in more detail below, system 100 may account for the angles (e.g., azimuth angle 406 and elevation angle 410) identified within orientation 400 by selecting a head-related impulse response corresponding to the angles. Distance 412 may also be accounted for in preparing and presenting spatialized audio for presentation to a user. For instance, in some implementations, distance 412 may be accounted for by encoding distance 412 together with angles 406 and 410 in the different head-related impulse responses in the library of head-related impulse responses. In this way, a selection and application of a particular head-related impulse response may account for the angles and the distance defining the spatial relationship between the virtual avatar and the virtual sound source.

In other implementations, rather than encoding distance 412 together with angles 406 and 410, each head-related impulse response in the library may only account for angles 406 and 410, while distance 412 may be modeled in other ways. For example, distance 412 may be modeled using effects such as modifying amplitude levels for the sound, adding different reverberation effects to the sound, and so forth. Such effects may be applied to the sound separately from the head-related impulse responses that encode orientation 400 with respect to angles 406 and 410. Specifically, for example, system 100 may determine an attenuation parameter representative of an amplitude level fall-off of the sound propagating over distance 412 from virtual avatar 302 to the virtual avatar 304. Thereafter, system 100 may generate the left-side and right-side versions of the sound by applying, along with the left-side and right-side components of the selected head-related impulse response, the attenuation parameter representative of the amplitude level fall-off of the sound.

Once system 100 has identified orientation 400 (e.g., including angles 406 and 410) and distance 412 between virtual avatar 302 and the virtual sound source (i.e., virtual avatar 304 in this example), system 100 may select a head-related impulse response from a library of head-related impulse responses. For example, a particular head-related impulse response corresponding precisely to orientation 400 may be selected if available, or a head-related impulse response that corresponds most nearly to orientation 400 may be selected.

A "head-related impulse response" may refer to data representative of how sound generated at one point in space (e.g., a point at which the sound originates) propagates through a particular medium (e.g., air, water, space, etc., as may be appropriate for a particular virtual reality world) to be received at one or more other points in space (e.g., such as at the ears of user 408). For example, a head-related impulse response may have a left-side component representative of how sound generated at a virtual sound source may propagate and be received at a left ear of a virtual avatar, as well as a right-side component representative of how sound generated at the virtual sound source may propagate and be received at a right ear of the virtual avatar.

Head-related impulse responses for different orientations of the virtual sound source and the virtual avatar at which the sound is received may be determined, derived, generated, etc., in any suitable way. For example, a left-side component of a particular head-related impulse response may be recorded at a left ear of a user model in response to impulse stimulation generated at a spatial location corresponding to a particular orientation of the virtual avatar with respect to the virtual sound source. Similarly, a right-side component of the particular head-related impulse response may be recorded at a right ear of the user model in response to the impulse stimulation generated at the spatial location corresponding to the particular orientation. Once recorded, these left-side and right-side components of the head-related impulse response may be collectively configured to model how sounds originating at the spatial location corresponding to the particular orientation are received by the user with respect to various biometric characteristics.

For example, the components of the head-related impulse response may collectively model how sounds propagate and are received by the user, accounting for biometric characteristics such as a distance between the left ear and the right ear of the user, a distance between the left ear and a left shoulder of the user, a distance between the right ear and a right shoulder of the user, a distance from a pinna of the left ear to a canal of the left ear, a distance from a pinna of the right ear to a canal of the right ear, a distance from the left ear to a top of a head of the user, a distance from the right ear to the top of the head of the user, and/or any other suitable biometric characteristics as may serve a particular implementation.

Figure 5B:
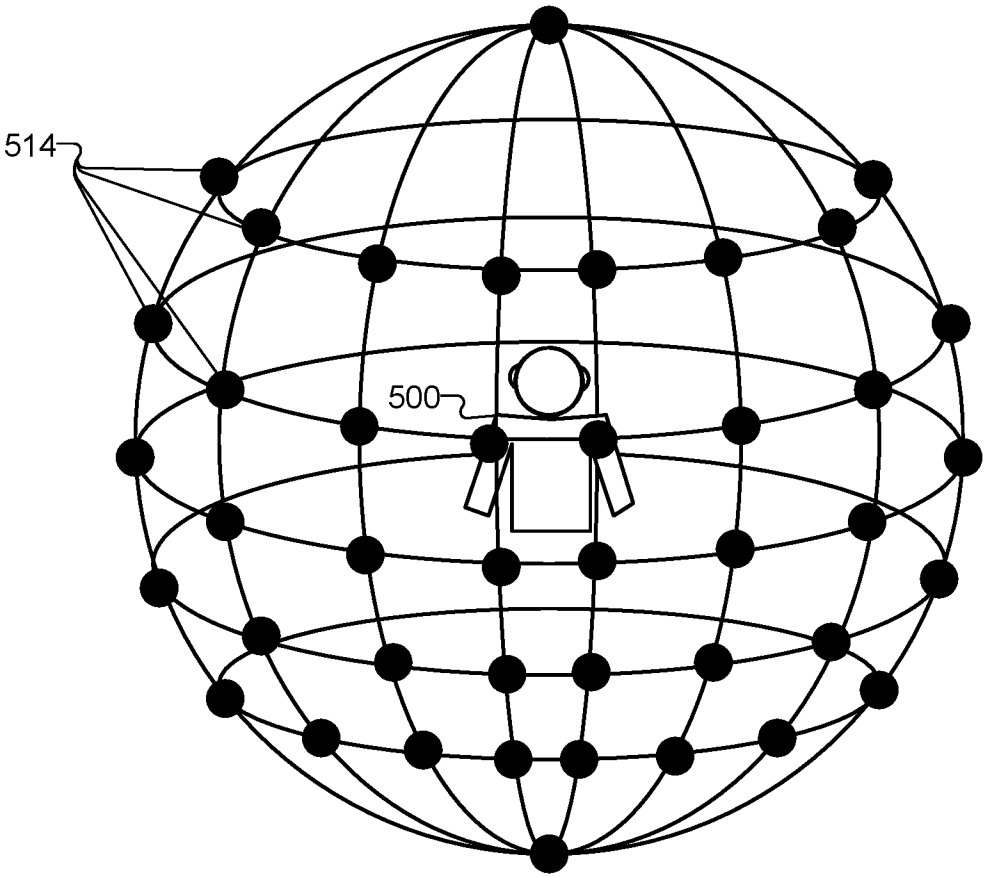
FIG. 5B illustrates a plurality of different spatial locations surrounding the user model of FIG. 5A and corresponding to different potential orientations of a virtual avatar with respect to a virtual sound source according to principles described herein.
Figure 5A:
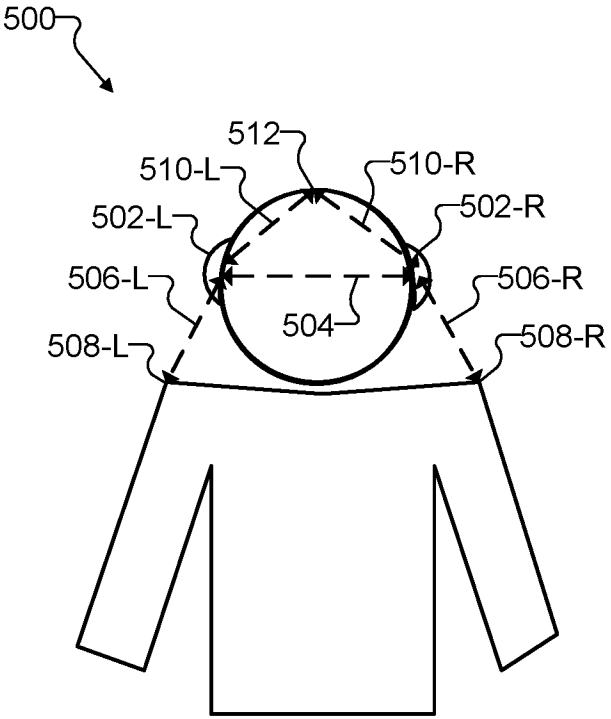
FIG. 5A illustrates an exemplary user model for recording head-related impulse responses according to principles described herein.

To illustrate, FIG. 5A shows an exemplary user model 500 for recording head-related impulse responses for a library of head-related impulse responses. For example, as impulse stimulation (e.g., sound pulses that include a wide range of different frequencies) is generated at different points in space surrounding user model 500 and recorded at a left ear 502-L (e.g., at an ear canal of ear 502-L) and at a right ear 502-R (e.g., at an ear canal of ear 502-R) of user model 500, any of the biometric characteristics mentioned above may be accounted for in the recorded head-related impulse response as a result of similar biometric characteristics modeled by user model 500. Specifically, the head-related impulse responses recorded at ears 502 (i.e., ears 502-L and 502-R) of user model 500 may account for the user biometric characteristics by simulating, for example, a distance 504 between ear 502-L and ear 502-R, a distance 506-L between ear 502-L and a left shoulder 508-L of user model 500, a distance 506-R between ear 502-R and a right shoulder 508-R of user model 500, a distance 510-L from ear 502-L to a top 512 of a head of user model 500, a distance 510-R from ear 502-R to top 512 of the head of user model 500, a distance from a pinna of ear 502-L to a canal of ear 502-L (not explicitly labeled in FIG. 5A), a distance from a pinna of ear 502-R to a canal of ear 502-R (not explicitly labeled in FIG. 5A), and so forth. Additionally or alternatively, the head-related impulse responses recorded at ears 502 may account for other aspects of how sound propagates to a listener. For instance, user model 500 may be immersed in different types of media (e.g., an air medium, a water medium, etc.) to account for sound propagation through the different types of media.

User model 500 may be implemented in the physical world or simulated in the virtual world in any manner as may serve a particular implementation. For example, in certain implementations, user model 500 may be implemented as a physical head and torso simulation dummy disposed near various spatial locations corresponding to potential orientations so as to detect impulse stimulation generated at the spatial locations. In these implementations, the left-side and right-side components of each head-related impulse response may be direct recordings of impulse stimulation generated at a particular spatial location associated with the head-related impulse response. For example, the impulse stimulation may be received by the physical head and torso simulation dummy in accordance with a biometric characteristic of the dummy that corresponds to the biometric characteristic of the user, such as any of the characteristics described above and/or illustrated in FIG. 5A.

In other implementations, user model 500 may similarly be implemented as a physical head and torso simulation dummy disposed near the spatial locations corresponding to the potential orientations so as to detect the impulse stimulation generated at the spatial locations. However, rather than using the direct recordings of the impulse stimulation for each head-related impulse response as described above, in these implementations system 100 may determine certain actual biometric characteristics of the user that may differ from the biometric characteristics of the dummy. In these implementations, the left-side and right-side components of each head-related impulse response may thus be modified recordings of the impulse stimulation generated at a particular spatial location associated with the head-related impulse response. For example, the impulse stimulation may be received by the physical head and torso simulation dummy in accordance with a biometric characteristic of the dummy (e.g., a head size represented by distance 504) that corresponds to the biometric characteristic of the user. The modified recordings may thus be modified to model the determined biometric characteristic of the user (e.g., the actual head size determined for the user, which may, for example, be represented by an ear-to-ear distance greater or less than distance 504 of the dummy) in place of the biometric characteristic of the dummy.

In other words, in these implementations, head-related impulse responses may be generated using a hybrid approach accounting for certain biometric characteristics of a head and torso simulation dummy representative of many users and not specific to the particular user using the head-related impulse response, while also accounting for biometric characteristics that are determined (e.g., measured, etc.) specifically for the particular user.

In yet other implementations, system 100 may determine one or more biometric characteristics of the user and user model 500 may be implemented as a virtual user model based on the determined biometric characteristics of the user, rather than on a physical head and torso simulation dummy. For example, the virtual user model implementation of user model 500 may be simulated as being disposed near various virtual spatial locations so as to detect virtual impulse stimulation simulated as being generated at the virtual spatial locations.

In other words, in these implementations, a completely virtualized user model analogous to the physical head and torso simulation dummy described above may be used to perform similar operations described above, but on a model that is entirely based on determined biometric characteristics of the user rather than on biometric characteristic of a physical dummy. Thus, in these implementations, the virtual spatial locations may implement (e.g., may be analogous to) the spatial locations corresponding to the potential orientations, and the virtual impulse stimulation may implement (e.g., may be analogous to) the impulse stimulation generated at the spatial locations. As such, the left-side and right-side components of each head-related impulse response may include synthesized recordings of the virtual impulse stimulation simulated as being generated at a particular virtual spatial location associated with the head-related impulse response. For example, the virtual impulse stimulation may be received by the virtual user model in accordance with the determined one or more biometric characteristics of the user.

Whether user model 500 is a physical head and torso simulation dummy, a completely virtualized user model, or something in between, the left-side and right-side components of each head-related impulse response may be recorded at ears 502-L and 502-R of user model 500, respectively, in response to impulse stimulation generated at different spatial locations corresponding to potential orientations of a virtual avatar with respect to a virtual sound source. For example, referring back to the examples illustrated above in relations to FIGS. 3 and 4, a selected head-related impulse response may be recorded at ears 502 in response to impulse stimulation generated at a spatial location corresponding to orientation 400 of virtual avatar 302 with respect to virtual avatar 304.

FIG. 5B illustrates a plurality of different spatial locations 514 surrounding user model 500 and corresponding to potential orientations of a virtual avatar with respect to a virtual sound source. Specifically, as shown, various spatial locations 514 may form a sphere around user model 500 so that for every potential orientation (e.g., every azimuth angle and elevation angle) that a sound source could have with respect to user model 500, a spatial location 514 may be relatively close by. While only a few spatial locations 514 are explicitly illustrated in FIG. 5B, it will be understood that any suitable number of spatial locations 514 may be employed and arranged around user model 500 as may serve a particular implementation. For example, fewer spatial locations 514 may be used in certain implementations, while more spatial locations 514 (e.g., several hundred or thousand spatial locations 514) surrounding user model on all sides may be used in other implementations.

While each of spatial locations 514 illustrated in FIG. 5B is associated with a particular orientation having only a particular azimuth angle and a particular elevation angle with respect to user model 500, it will be understood that other spatial locations in other implementations may further represent other aspects of the particular orientation, such as the distance from user model 500. For example, concentric spheres of spatial locations similar to spatial locations 514 may be used where each sphere includes spatial orientations associated with a different distance from user model 500. Alternatively, as described above, the distances may be handled in other ways such as by decreasing sound intensity and increasing reverberant energy associated with head-related impulse responses that are relatively far away.

In order to generate (e.g., record and store) head-related impulse responses for a library of head-related impulse responses corresponding to different potential orientations of a virtual avatar with respect to a virtual sound source, impulse stimulation may be generated at each spatial location 514, recorded at ears 502 of user model 500, and stored as left-side and right-side components of a head-related impulse response in the library. The impulse stimulation may be implemented as a relatively short pulse of sound including a range of frequencies audible to the human ear. For example, the impulse stimulation (e.g., the short sound pulse) may include or be implemented by a white noise signal, a chirp signal, or any other suitable signal that includes the range of frequencies audible to a human ear.

Regardless of how the impulse stimulation is implemented, the impulse stimulation may cause respective impulse responses at each ear 502 of user model 500 in accordance with the biometric characteristics modeled by user model 500, the spatial location 514 from which the impulse stimulation is applied, and so forth. As such, for example, there may be interaural time differences, interaural level differences, and/or other effects encoded or represented within the impulse responses that are recorded. More particularly, each recorded impulse response for each spatial location 514 may include different effects that, when applied to any particular sound and then rendered for a user, make the sound seem as if it comes from the direction of the particular spatial location 514 for which the impulse response was recorded. Because these recorded impulse responses reflect specific head-related biometric characteristics of user model 500, these impulse responses are referred to as "head-related impulse responses."

FIGS. 6A through 6D illustrate exemplary components of an exemplary head-related impulse response that may be recorded at ears 502 of user model 500 in response to impulse stimulation projected from a particular spatial location 514. For example, the exemplary head-related impulse response may be at an orientation having an azimuth angle less than 0° and greater than 180° (i.e., so as to be located somewhere to the left-hand side of user model 500).

Figure 6B:
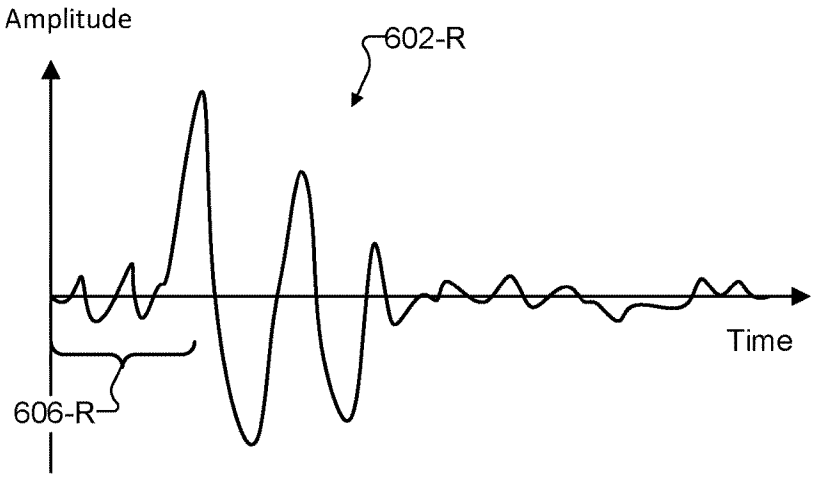
FIG. 6B illustrates an exemplary right-side component of a head-related impulse response recorded using the user model of FIG. 5A according to principles described herein.
Figure 6A:
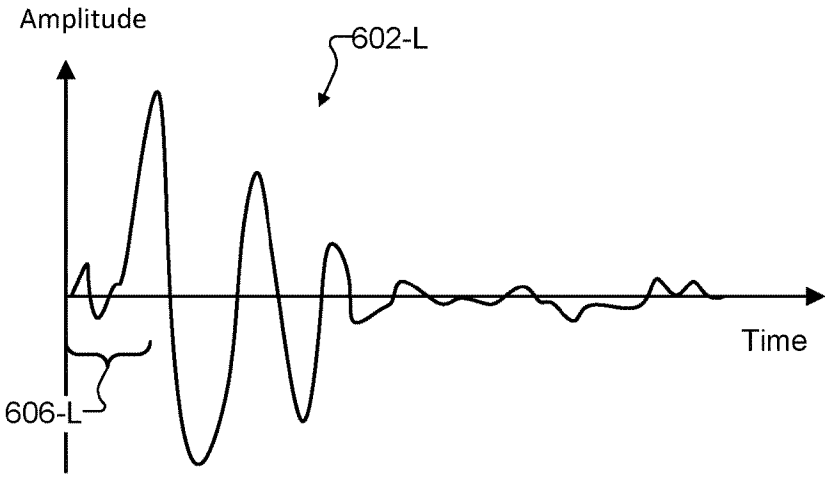
FIG. 6A illustrates an exemplary left-side component of a head-related impulse response recorded using the user model of FIG. 5A according to principles described herein.
Figure 6D:
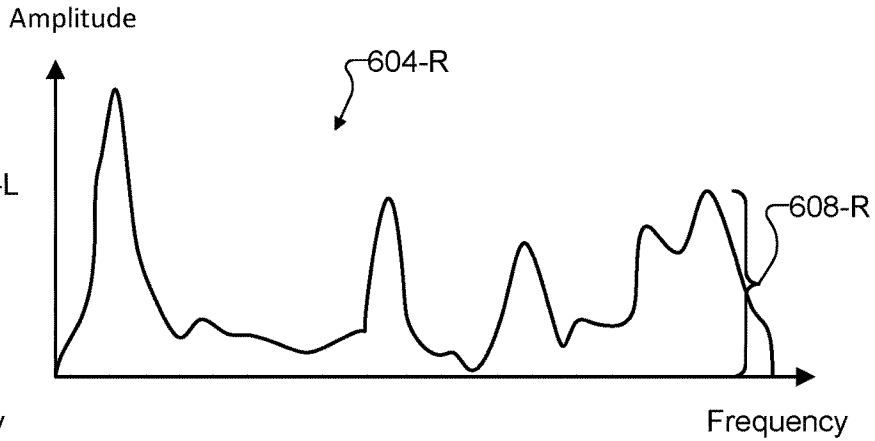
FIG. 6D illustrates the exemplary right-side component of the head-related impulse response of FIG. 6B depicted in the frequency domain according to principles described herein.
Figure 6C:
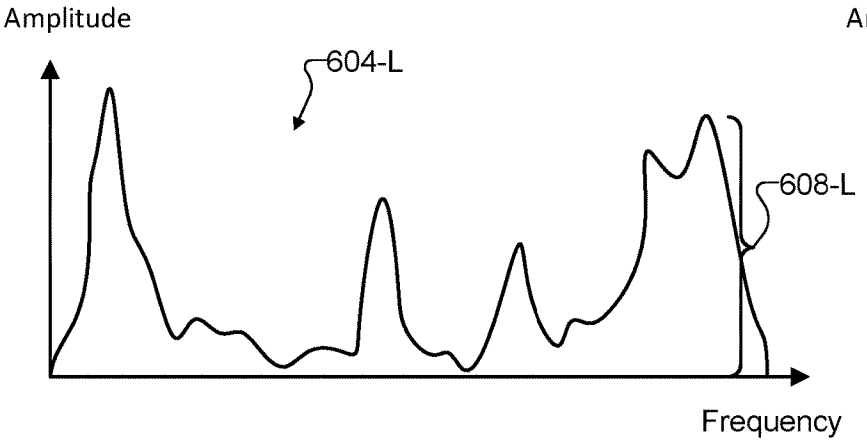
FIG. 6C illustrates the exemplary left-side component of the head-related impulse response of FIG. 6A depicted in the frequency domain according to principles described herein.

Specifically, FIGS. 6A and 6B illustrate, respectively, exemplary left-side and right-side components of a head-related impulse response recorded using user model 500 in the time domain, while FIGS. 6C and 6D illustrate, respectively, the exemplary left-side and right-side components of the head-related impulse responses of FIGS. 6A and 6B in the frequency domain. While head-related impulse responses are conventionally represented in the time domain (e.g., as an amplitude with respect to time), head-related impulse response may also be transformed to and represented in the frequency domain (e.g., as an amplitude with respect to frequency) for various purposes. In some examples, a head-related impulse response may be referred to as a head-related transfer function when transformed to the frequency domain. As such, FIG. 6A may depict a left-side component 602-L of a head-related impulse response, FIG. 6B may depict a right-side component 602-R of the head-related impulse response, FIG. 6C may depict a left-side component 604-L of a head-related transfer function corresponding to the head-related impulse response, and FIG. 6D may depict a right-side component 604-R of the head-related transfer function.

To illustrate an interaural time difference between components 602-L and 602-R due to the left-side offset of the particular spatial location 514 at which the exemplary impulse stimulation is generated, components 602-L and 602-R have different respective delays 606 (i.e., delays 606-L and 606-R) between a common point in time at the origin of each graph and a first peak recorded. In other words, as depicted by the longer length of delay 606-R of component 602-R as compared to the shorter length of delay 606-L of component 602-L, impulse stimulation generated at the spatial location to the left of user model 500 may arrive at left ear 502-L slightly before arriving at right ear 502-R. This interaural time difference may be particularly pronounced for relatively low frequencies.

Similarly, to illustrate an interaural level difference between components 604-L and 604-R due to the left-side offset of the particular spatial location 514 at which the exemplary impulse stimulation is generated, components 604-L and 604-R have different amplitude levels 608 (i.e., levels 608-L and 608-R). In other words, as depicted by smaller amplitudes of levels 608-R of component 604-R as compared to the larger amplitudes of levels 608-L of component 604-L, impulse stimulation generated at the spatial location to the left of user model 500 may be detected at left ear 502-L with a slightly greater level as compared to the level detected at right ear 502-R. As shown, this interaural level difference may be particularly pronounced for relatively high frequencies.

FIGS. 6A through 6D depict different representations of left and right components of a single head-related impulse response. However, certain implementations may provide many different head-related impulse response options for the many different potential orientations (e.g., azimuth angles, elevation angles, etc.) that a virtual avatar may have with respect to a virtual sound source within a virtual space (e.g., corresponding, for example, to the many different spatial locations 514 illustrated in FIG. 5B). These head-related impulse responses may be stored and organized in any suitable way. For example, as mentioned above, system 100 may maintain or have access to a library of head-related impulse responses corresponding to different potential orientations from which system 100 may select.

To illustrate, FIG. 7 shows an exemplary library 700 of head-related impulse responses from which a particular head-related impulse response may be selected by system 100. For example, once system 100 has identified an orientation of a virtual avatar with respect to a virtual sound source (e.g., orientation 400 of virtual avatar 302 with respect to virtual avatar 304, described above), system 100 may access library 700 to select one of the head-related impulse responses included therein based on the identified orientation.

Library 700 may be organized in any manner as may serve a particular implementation. For example, as shown, a different left-side component and right-side component (e.g., left and right components "1" through "M") may be indexed in library 700 by a particular azimuth angle and a particular elevation angle. In other words, each head-related impulse response in library 700 (i.e., each pair of a left-side and a right-side component) may be associated with and/or accessible by way of a particular combination of an azimuth angle (e.g., "Azimuth_Angle_01" through "Azimuth_Angle_N") and an elevation angle (e.g., "Elevation_Angle_01" through "Elevation_Angle_04").

It will be understood that "M" and "N" may represent any suitable integers describing a number of head-related impulse responses and azimuth angles, respectively, that may serve a particular implementation. Additionally, it will be understood that, while four different elevation angles are illustrated for library 700, any suitable number of elevation angles may be used in various implementations. Additionally, while indexing columns for azimuth angles and elevation angles are all that is explicitly shown in library 700, it will be understood that other columns including other aspects of each potential orientation (e.g., such as a distance between the virtual avatar and the virtual sound source) may further be included in one or more additional indexing columns as may serve a particular implementation.

To select a particular head-related impulse response from library 700 based on a particular identified orientation (e.g., orientation 400), system 100 may use indexing provided by library 700 (e.g., which may be implemented in a look-up table or any other suitable form) in any suitable way. For example, system 100 may determine which of the indexed azimuth angles 1 through N are closest to the identified azimuth angle of the identified orientation, then, for that azimuth angle, determine which of the indexed elevation angles 1 through 4 are closest to the identified elevation angle of the identified orientation. Based on these determinations, the indexing of library 700 may allow system 100 to select a particular head-related impulse response. For example, if system 100 identifies "Azimuth_Angle_02" to be closest to the identified azimuth angle and "Elevation_Angle_04" to be closest to the identified elevation angle, system 100 may select the head-related impulse response including "Left Component 8" and "Right Component 8" from library 700 as the selected head-related impulse response.

Once an appropriate head-related impulse response has been selected in this way, the selected head-related impulse response may be applied to a sound generated by the virtual sound source to generate different versions of the sound to be provided to each ear of the user.

Figure 8:
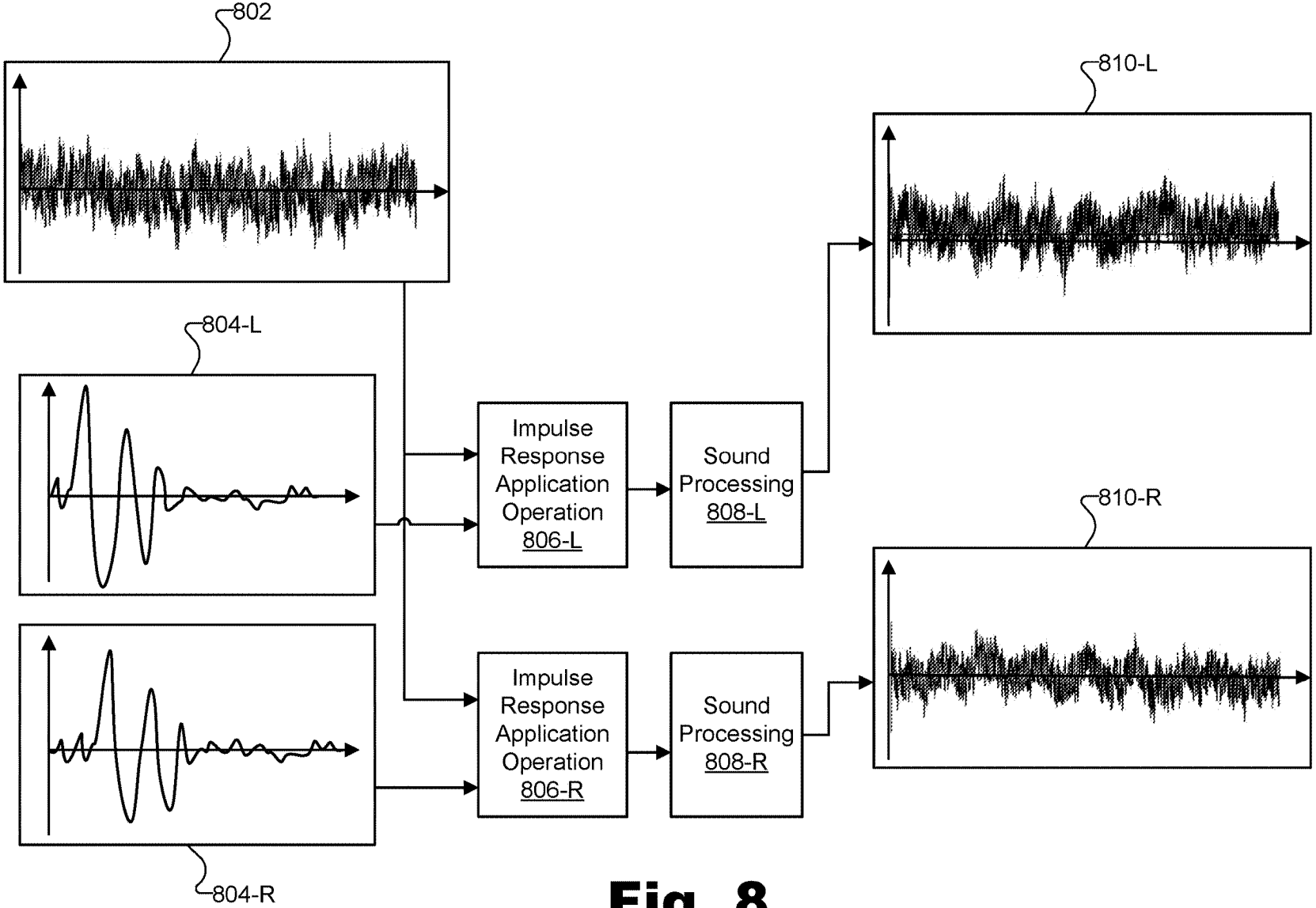
FIG. 8 illustrates an exemplary manner of generating a left-side and a right-side version of a sound by applying a selected head-related impulse response to the sound according to principles described herein.

FIG. 8 illustrates an exemplary manner of generating a left-side and a right-side version of a sound by applying a selected head-related impulse response to the sound. Specifically, a sound 802 is shown in FIG. 8 to represent a sound that is to be presented to a user while the user is engaged in a virtual experience. For example, referring back to the example of FIGS. 2 and 3 described above, sound 802 may be a voice communication spoken by user 212 (e.g., a sound generated by virtual avatar 304) that is to be presented to user 208 (e.g., who is represented in virtual space 300 by virtual avatar 302).

Based on an identified orientation (e.g., such as orientation 400), a head-related impulse response including a left-side component 804-L and a right-side component 804-R (e.g., similar to components 602-L and 602-R described above, for example) may be selected from a library of head-related impulse responses (e.g., similar to library 700 described above). Components 804-L and 804-R may each be applied to sound 802 by respective impulse response application operations 806 (e.g., impulse response application operation 806-L for applying component 804-L to sound 802, and impulse response application operation 806-R for applying component 804-R to sound 802).

Operations 806 may be performed in any suitable manner. For example, operations 806 may be performed in the time domain by convolving each respective component 804-L and 804-R of the head-related impulse response with sound 802. Additionally or alternatively, operations 806 may include a transformation operation in which sound 802 is transformed (e.g., converted) to the frequency domain by way of a fast frequency transform ("FFT") technique or the like, and the head-related impulse response including components 804-L and 804-R is similarly transformed to a frequency domain head-related transfer function such as described above in relation to head-related transfer function components 604-L and 604-R. In the frequency domain, operations 806 may multiply each of the head-related transfer function by the transformed version of sound 802, then transform the result back to the time domain.

Additional sound processing 808 (e.g., sound processing 808-L and 808-R) may be performed before or after operations 806 (illustrated as being performed after operations 806 in FIG. 8) on each of the versions of sound 802 to which operations 806 have applied (or will apply) components 804-L and 804-R of the selected head-related impulse response. As a result of operations 806 and additional processing 808, two different versions of sound 802 including a left-side version 810-L and a right-side version 810-R may ultimately be generated for presentation, respectively, to the user (e.g., user 208) at the left and right ears of the user. In this way, the user will hear sound 802 not as sound 802 was recorded (e.g., by a monaural microphone built into the headset of user 212 in the real-world space in which user 212 is located while experiencing virtual space 300), but as sound 802 should sound when generated by the virtual sound source in the virtual space (e.g., the spatialized audio presentation including the directionality, head-related effects, and other aspects of virtual space 300 that would affect the sound if virtual space 300 were a real-world space).

Like operations 806, sound processing 808 may be performed by system 100 as part of generating versions 810 of sound 802 for presentation to the user. Sound processing 808 may involve processing left-side and right-side versions of sound 802 to add further effects in any manner as may serve a particular implementation. For example, while the directionality of where the sound is coming from and the head-related effects may be already accounted for by applying the selected head-related impulse response (i.e., components 804-L and 804-R) in operations 806, sound processing 808 may apply other effects to simulate various aspects of virtual space 300, virtual objects included within virtual space 300, the manner in which the virtual sound source generates sound 802, and any other suitable aspects of the virtual experience that may affect how sound 802 would propagate through the virtual space and/or be perceived by the user.

For instance, as one example, sound processing 808 may include determining a delay parameter representative of a reflection time of an echo of sound 802 (e.g., an echo from a virtual surface included within virtual space 300), and determining a diffusion parameter for the echo of sound 802 based on a virtual material within virtual space 300 from which the echo of the sound reflects (e.g., a virtual material from which the virtual surface is constructed). Thus, sound processing 808 may include generating left-side version 810-L and right-side version 810-R of sound 802 by applying (e.g., before or after components 804 of the selected head-related impulse response have been applied), a reverberation effect to sound 802. For example, the reverberation effect may be applied based on the delay parameter and the diffusion parameter.

Figure 9:
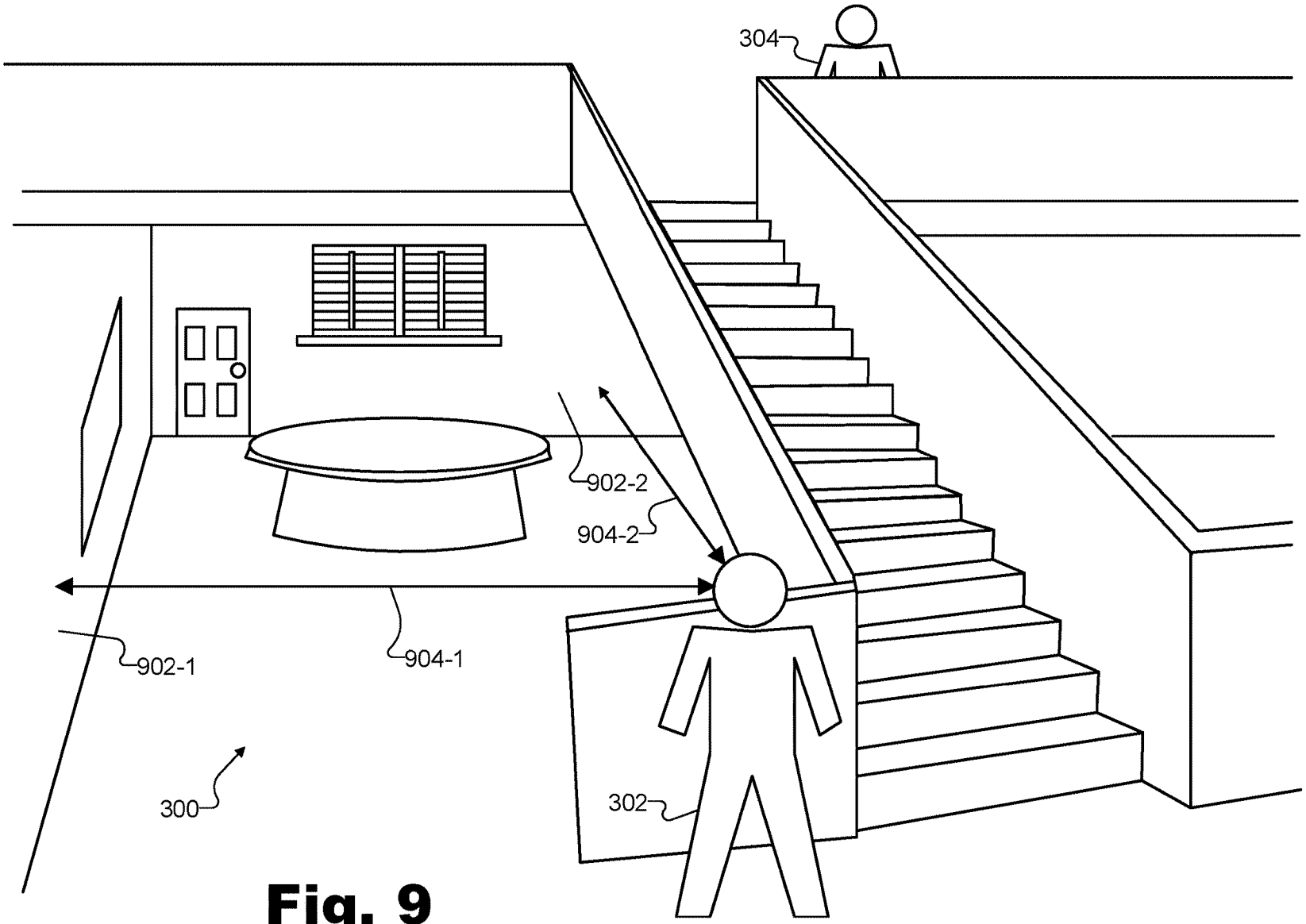
FIG. 9 illustrates certain aspects of an exemplary reverberation effect that may be applied to a sound that virtually propagates within the exemplary virtual space of FIG. 3 according to principles described herein.

FIG. 9 illustrates certain aspects of an exemplary reverberation effect that may be applied to a sound (e.g., sound 802) that virtually propagates within virtual space 300. While the room represented in virtual space 300 is virtual, if this room existed in the real-world, the room would cause sound to echo and/or be absorbed in various ways to have various reverberation properties. For example, sounds heard or spoken by virtual avatar 302 would bounce off various walls 902 (e.g., walls 902-1, 902-2, etc.) in the room to form various echoes or reflections 904 (e.g., early reflection 904-1 for a wall relatively close to virtual avatar 302, late reflection 904-2 for a wall relatively far away from virtual avatar 302, etc.) that would be heard in a diffused and diminished form shortly after the primary sound (i.e., following short propagation time delays).

Because walls 902 may be different distances from virtual avatars 302 and 304, different delay parameters associated with reflections 904 from each wall 902 may be determined so that a reverberation effect that accounts for early and late reflections may be applied to the sound presented to the user. Similarly, because walls 902 may be constructed of different types of materials that absorb, reflect, scatter, and otherwise transform sound waves reflecting from them in different ways, different diffusion parameters associated with reflections 904 from each wall 902 may also be determined and accounted for in the reverberation effect. For example, material that is more smooth (e.g., polished metal or the like) may tend to reflect sound more efficiently and/or with less diffusion, while material that is more rough or porous (e.g., wood or the like) may tend to reflect sound less efficiently and/or with more diffusion.

Reflections 904 illustrated in FIG. 9 represent simple examples of an early reflection (i.e., reflection 904-1) and a late reflection (i.e., reflection 904-2) that may be simulated for a room such as that included in virtual space 300. However, it will be understood that various additional reflections from walls and/or other virtual objects included within virtual space 300 may further be simulated with as much detail as may be appropriate to accurately model the reverberation in the room while balancing other factors such as processing power required to simulate the reflections and so forth.

As another example of an aspect of the virtual experience that may be simulated along with spatialization and reverberation, sound processing 808 may include determining an occlusion parameter representative of an effect of a virtual occlusion object on the sound to be presented to the user. For instance, the virtual occlusion object may be a virtual object obstructing a direct sound propagation path between the virtual sound source and the virtual avatar within the virtual space. Thus, sound processing 808 may include generating left-side version 810-L and right-side version 810-R of sound 802 by applying (e.g., before or after components 804 of the selected head-related impulse response have been applied) an occlusion effect to sound 802. For example, the occlusion effect may be applied based on the occlusion parameter.

Figure 10:
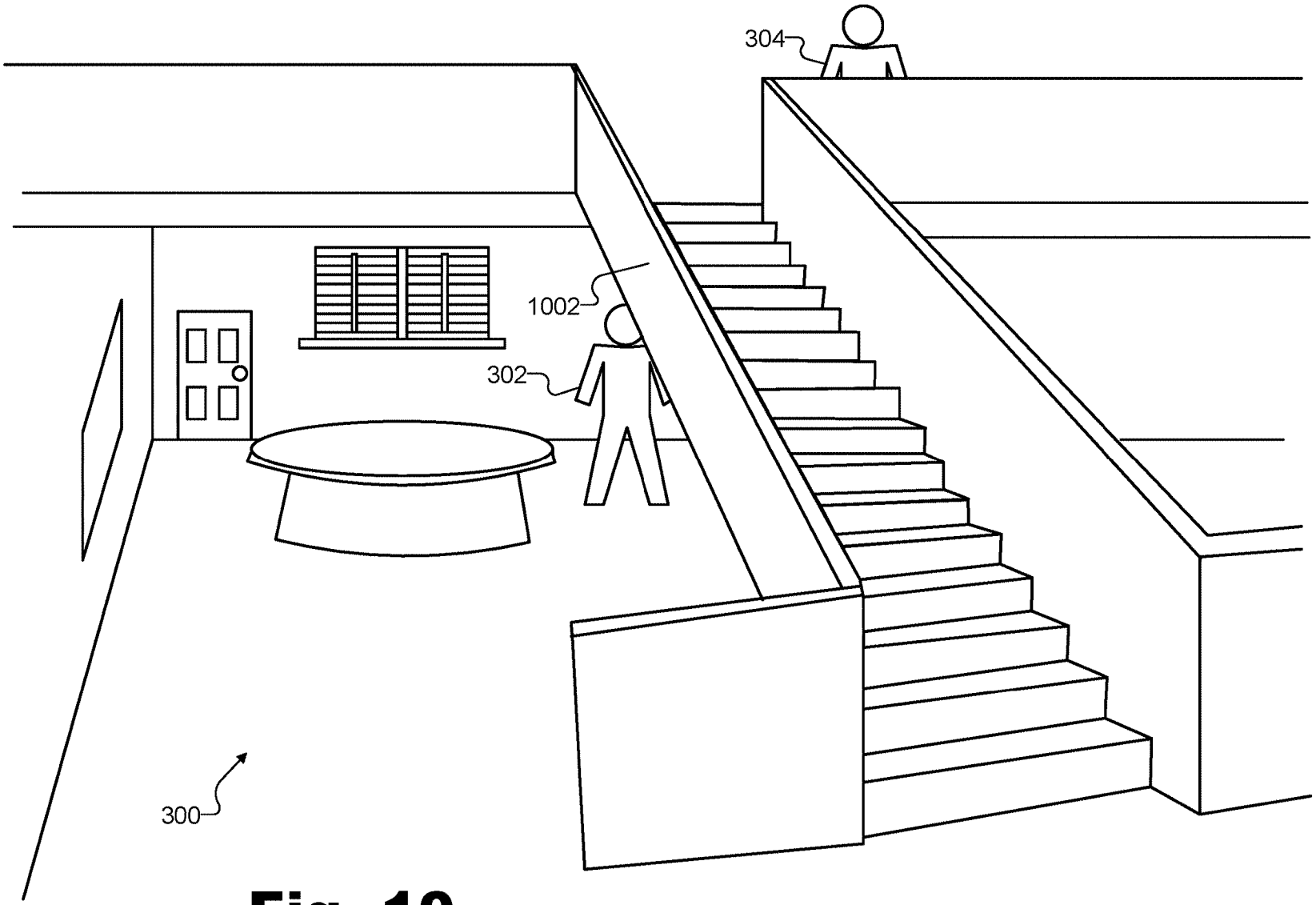
FIG. 10 illustrates certain aspects of an exemplary occlusion effect that may be applied to a sound that virtually propagates within the exemplary virtual space of FIG. 3 according to principles described herein.

FIG. 10 illustrates certain aspects of an exemplary occlusion effect that may be applied to a sound (e.g., sound 802) that virtually propagates within virtual space 300. Specifically, as shown, virtual avatar 302 has moved from the bottom of the staircase into the far part of the room such that an occlusion object 1002 (i.e., the staircase and/or the floor under virtual avatar 304) obstructs a direct sound propagation path between virtual avatars 304 and 302.

While a well-placed microphone (e.g., a headset microphone or the like) may pick up the sound spoken by user 212 (i.e., the sound generated by virtual avatar 304 in virtual space 300) directly without the sound being occluded or blocked, virtual objects such as occlusion object 1002 or other virtual objects (e.g., other avatars or characters, walls, furniture, etc.) within virtual space 300 may be located between virtual avatars 304 and 302 in virtual space 300, obstructing the direct sound propagation path between them. As such, it may be desirable for sound processing 808 to include applying the occlusion effect to simulate the audible effects of sound propagating through and/or around occlusion object 1002 in any manner as may serve a particular implementation.

As yet another example of an aspect of the virtual experience that may be simulated along with spatialization, reverberation, and object occlusion, sound processing 808 may include determining a source projection parameter representative of an effect of a direction in which the virtual sound source projects the generated sound to be presented to the user. For example, if a speaker is facing a listener in the real world (e.g., such that the listener is physically located within a cone of propagation originating at the speaker's mouth), high frequency components of the speech tend to propagate more reliably and effectively to the listener's ears as compared to if the speaker is facing away from the listener. Thus, sound processing 808 may include generating left-side version 810-L and right-side version 810-R of sound 802 by applying (e.g., before or after components 804 of the selected head-related impulse response have been applied) a source projection effect to the sound. For example, the source projection effect may be applied based on the source projection parameter.

Figure 11:
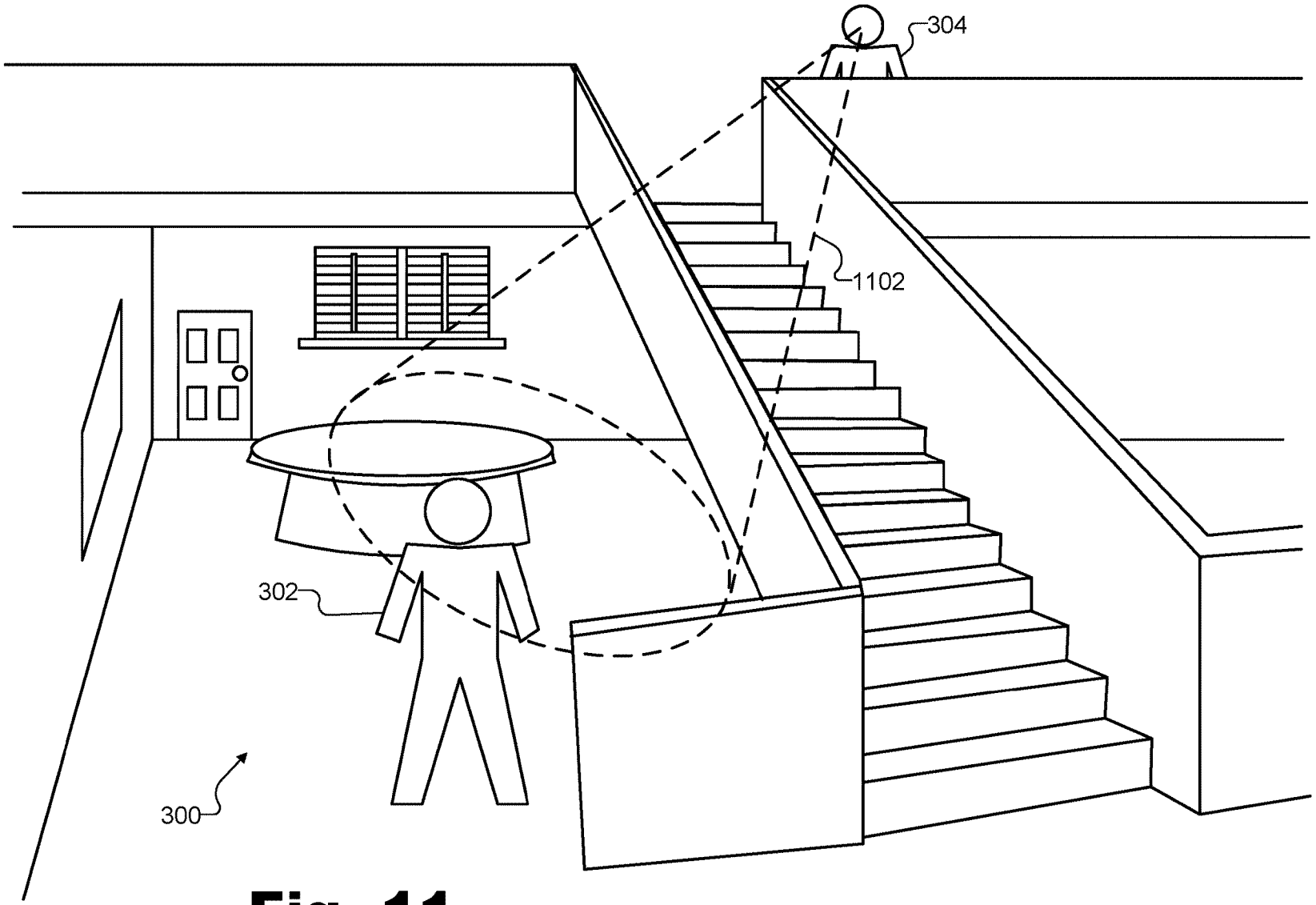
FIG. 11 illustrates certain aspects of an exemplary source projection effect that may be applied to a sound that virtually propagates within the exemplary virtual space of FIG. 3 according to principles described herein.

FIG. 11 illustrates certain aspects of an exemplary source projection effect that may be applied to a sound (e.g., sound 802) that virtually propagates within virtual space 300. Specifically, as shown, virtual avatar 302 is once again located near the bottom of the staircase where there is again a direct sound propagation path between virtual avatars 304 and 302. A cone of propagation 1102 originating at the mouth of virtual avatar 304 as the sound is generated (e.g., as user 212 speaks to thereby generate the sound by virtual avatar 304) is shown to indicate that virtual avatar 304 is virtually facing virtual avatar 302. As a result of virtual avatar 302 being located within cone of propagation 1102, the source projection effect may be applied by including more high frequencies, more sound intensity, etc., as compared to if virtual avatar 302 was not located within cone of propagation 1102 (e.g., such as if the back of virtual avatar 304 was turned to virtual avatar 302 or the like).

While FIGS. 9-11 have illustrated a few potential effects that may be applied to spatialized audio presentations to increase the realism of the sounds being communicated and perceived by users, it will be understood that various other effects, as well as modifications and/or extensions of the effects described herein, may similarly be implemented as may serve a particular implementation.

Figure 12:
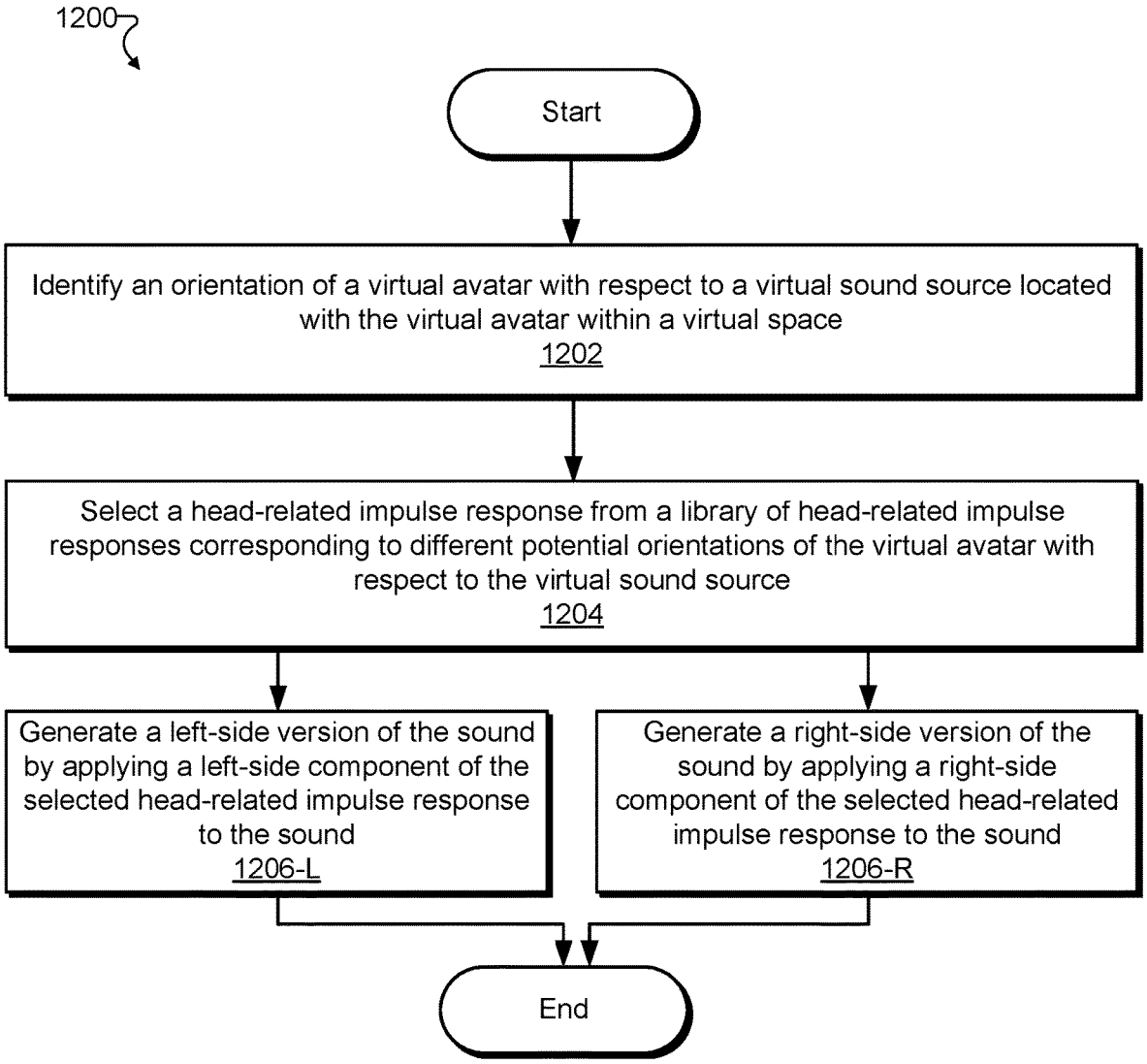
FIG. 12 illustrates an exemplary method for spatialized audio presentation during a virtual experience according to principles described herein.

FIG. 12 illustrates an exemplary method for spatialized audio presentation during a virtual experience. While FIG. 12 illustrates exemplary operations according to one embodiment, other embodiments may omit, add to, reorder, and/or modify any of the operations shown in FIG. 12. One or more of the operations shown in FIG. 12 may be performed by system 100, any components included therein, and/or any implementation thereof.

In operation 1202, a spatialized audio presentation system may identify an orientation of a virtual avatar with respect to a virtual sound source located with the virtual avatar within a virtual space. For example, the virtual avatar may be a virtual avatar of a user engaged in a virtual experience within the virtual space, and the virtual sound source may generate a sound to be presented to the user while the user is engaged in the virtual experience. Operation 1202 may be performed in any of the ways described herein.

In operation 1204, the spatialized audio presentation system may select a head-related impulse response from a library of head-related impulse responses corresponding to different potential orientations of the virtual avatar with respect to the virtual sound source. For example, the spatialized audio presentation system may select the head-related impulse response based on the orientation of the virtual avatar with respect to the virtual sound source identified in operation 1202. In some examples, the selected head-related impulse response may include a left-side component and a right-side component. Operation 1204 may be performed in any of the ways described herein.

In operation 1206-L, the spatialized audio presentation system may generate a left-side version of the sound for presentation to the user at a left ear of the user while the user is engaged in the virtual experience. For example, the spatialized audio presentation system may generate the left-side version of the sound by applying the left-side component of the selected head-related impulse response to the sound. Operation 1206-L may be performed in any of the ways described herein.

In operation 1206-R, the spatialized audio presentation system may generate a right-side version of the sound for presentation to the user at a right ear of the user while the user is engaged in the virtual experience. For example, the spatialized audio presentation system may generate the right-side version by applying the right-side component of the selected head-related impulse response to the sound. Operation 1206-R may be performed in any of the ways described herein.

Figure 13:
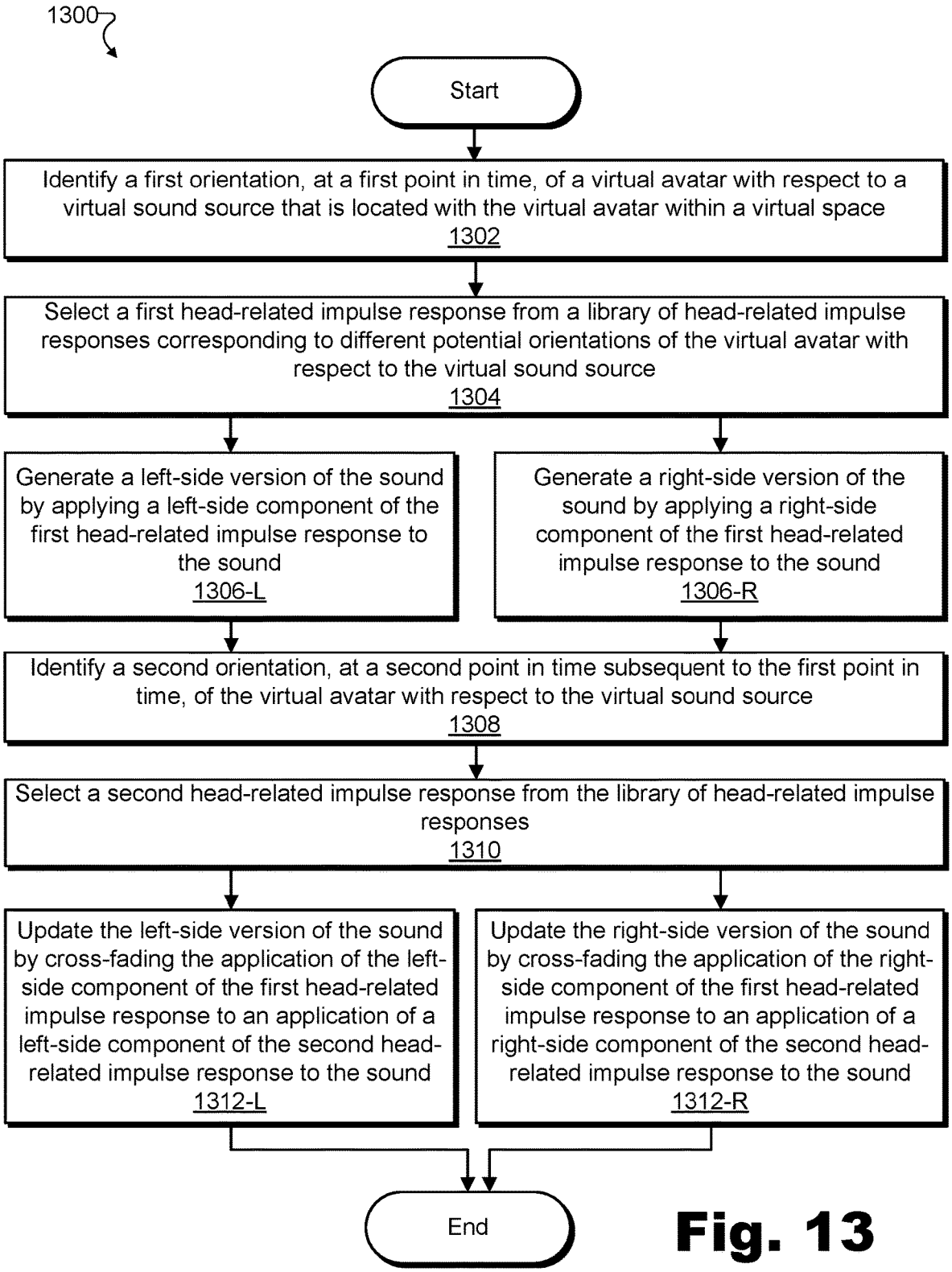
FIG. 13 illustrates another exemplary method for spatialized audio presentation during a virtual experience according to principles described herein.

FIG. 13 illustrates another exemplary method for spatialized audio presentation during a virtual experience. While FIG. 13 illustrates exemplary operations according to one embodiment, other embodiments may omit, add to, reorder, and/or modify any of the operations shown in FIG. 13. One or more of the operations shown in FIG. 13 may be performed by system 100, any components included therein, and/or any implementation thereof.

In operation 1302, a spatialized audio presentation system may identify a first orientation, at a first point in time, of a virtual avatar with respect to a virtual sound source that is located with the virtual avatar within a virtual space. For example, the virtual avatar may be a virtual avatar of a user engaged in a virtual experience within the virtual space and the virtual sound source may generates a sound to be presented to the user while the user is engaged in the virtual experience. Operation 1302 may be performed in any of the ways described herein.

In operation 1304, the spatialized audio presentation system may select a first head-related impulse response from a library of head-related impulse responses corresponding to different potential orientations of the virtual avatar with respect to the virtual sound source. For example, the spatialized audio presentation system may select the first head-related impulse response based on the first orientation of the virtual avatar with respect to the virtual sound source identified in operation 1302. In some examples, the first head-related impulse response may include a left-side component and a right-side component. Operation 1304 may be performed in any of the ways described herein.

In operation 1306-L, the spatialized audio presentation system may generate a left-side version of the sound for presentation to the user at a left ear of the user while the user is engaged in the virtual experience. For example, the spatialized audio presentation system may generate the left-side version of the sound by applying the left-side component of the first head-related impulse response to the sound. Operation 1306-L may be performed in any of the ways described herein.

In operation 1306-R, the spatialized audio presentation system may generate a right-side version of the sound for presentation to the user at a right ear of the user while the user is engaged in the virtual experience. For example, the spatialized audio presentation system may generate the right-side version of the sound by applying the right-side component of the first head-related impulse response to the sound. Operation 1306-R may be performed in any of the ways described herein.

In operation 1308, the spatialized audio presentation system may identify a second orientation, at a second point in time subsequent to the first point in time, of the virtual avatar with respect to the virtual sound source. Operation 1308 may be performed in any of the ways described herein.

In operation 1310, the spatialized audio presentation system may select a second head-related impulse response from the library of head-related impulse responses. For example, the spatialized audio presentation system may select the second head-related impulse response based on the second orientation identified in operation 1308. Like the first head-related impulse response selected in operation 1304, the second head-related impulse response may include a left-side component and a right-side component. Operation 1310 may be performed in any of the ways described herein.

In operation 1312-L, the spatialized audio presentation system may update the left-side version of the sound by cross-fading the application of the left-side component of the first head-related impulse response to an application of the left-side component of the second head-related impulse response to the sound. Operation 1312-L may be performed in any of the ways described herein.

In operation 1312-R, the spatialized audio presentation system may update the right-side version of the sound by cross-fading the application of the right-side component of the first head-related impulse response to an application of the right-side component of the second head-related impulse response to the sound. Operation 1312-R may be performed in any of the ways described herein.

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 14:
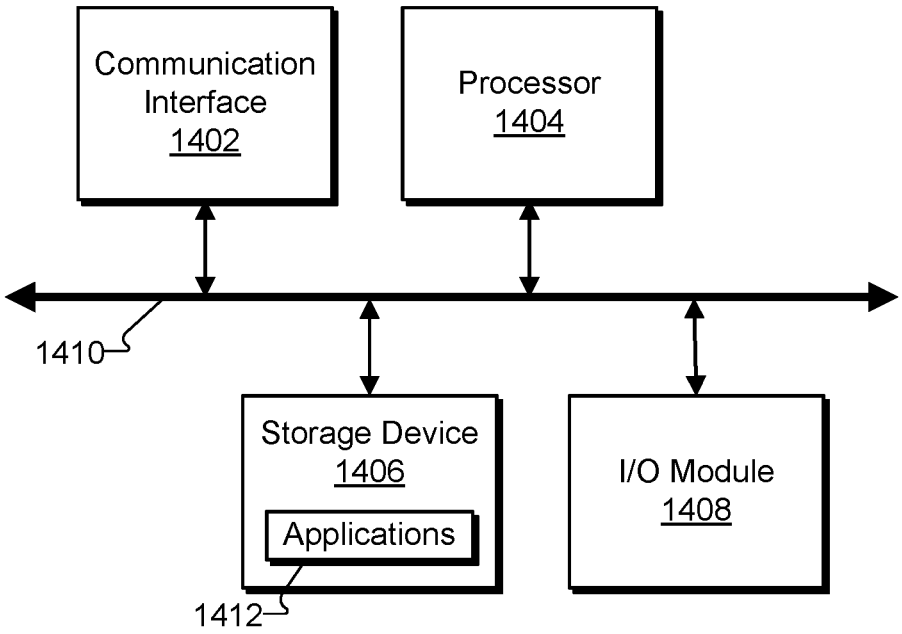
FIG. 14 illustrates an exemplary computing device according to principles described herein.

FIG. 14 illustrates an exemplary computing device 1400 that may be specifically configured to perform one or more of the processes described herein. As shown in FIG. 14, computing device 1400 may include a communication interface 1402, a processor 1404, a storage device 1406, and an input/output ("I/O") module 1408 communicatively connected via a communication infrastructure 1410. While an exemplary computing device 1400 is shown in FIG. 14, the components illustrated in FIG. 14 are not intended to be limiting. Additional or alternative components may be used in other embodiments. Components of computing device 1400 shown in FIG. 14 will now be described in additional detail.

Communication interface 1402 may be configured to communicate with one or more computing devices. Examples of communication interface 1402 include, without limitation, a wired network interface (such as a network interface card), a wireless network interface (such as a wireless network interface card), a modem, an audio/video connection, and any other suitable interface.

Processor 1404 generally represents any type or form of processing unit capable of processing data or interpreting, executing, and/or directing execution of one or more of the instructions, processes, and/or operations described herein. Processor 1404 may direct execution of operations in accordance with one or more applications 1412 or other computer-executable instructions such as may be stored in storage device 1406 or another computer-readable medium.

Storage device 1406 may include one or more data storage media, devices, or configurations and may employ any type, form, and combination of data storage media and/or device. For example, storage device 1406 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 1406. For example, data representative of one or more executable applications 1412 configured to direct processor 1404 to perform any of the operations described herein may be stored within storage device 1406. In some examples, data may be arranged in one or more databases residing within storage device 1406.

I/O module 1408 may include one or more I/O modules configured to receive user input and provide user output. One or more I/O modules may be used to receive input for a single virtual experience. I/O module 1408 may include any hardware, firmware, software, or combination thereof supportive of input and output capabilities. For example, I/O module 1408 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1408 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1408 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1400. For example, one or more applications 1412 residing within storage device 1406 may be configured to direct processor 1404 to perform one or more processes or functions associated with facilities 102 or 104 of system 100. Likewise, storage facility 106 of system 100 may be implemented by or within storage device 1406.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

selecting, by a spatialized audio presentation system based on an orientation of an avatar with respect to a virtual sound source, a head-related impulse response from a library of head-related impulse responses corresponding to different potential orientations of the avatar with respect to the virtual sound source;

applying, by the spatialized audio presentation system, the selected head-related impulse response to a sound that is generated by the virtual sound source and is to be presented to a user associated with the avatar;

determining, by the spatialized audio presentation system, a source projection parameter indicative of an orientation of a cone of propagation corresponding to the sound and originating at the virtual sound source;

applying, by the spatialized audio presentation system based on the source projection parameter, a source projection effect to the sound, wherein:

the source projection effect is a first effect if the virtual sound source is facing the avatar such that the avatar is located within the cone of propagation, and the source projection effect is a second effect distinct from the first effect if the virtual sound source is facing away from the avatar such that the avatar is not located within the cone of propagation; and applying, by the spatialized audio presentation system, an additional effect to the sound that is to be presented to the user.

2. The method of claim 1, wherein:

the sound that is generated by the virtual sound source and is to be presented to the user is a voice communication spoken by an additional user associated with the virtual sound source and engaged in a virtual experience along with the user;

the virtual sound source that generates the sound to be presented to the user is a virtual avatar of the additional user; and the cone of propagation originates at a mouth of the virtual avatar of the additional user.

3. The method of claim 1, further comprising:

determining, by the spatialized audio presentation system, a delay parameter representative of a reflection time of an echo of the sound that is to be presented to the user; and determining, by the spatialized audio presentation system, a diffusion parameter for the echo based on a material from which the echo virtually reflects when propagating from the virtual sound source to the avatar;

wherein the additional effect applied to the sound is a reverberation effect applied based on the delay parameter and the diffusion parameter.

4. The method of claim 1, further comprising:

determining, by the spatialized audio presentation system, a first delay parameter representative of a reflection time of an early echo of the sound that is to be presented to the user, the early echo simulating a reflection of the sound from a surface that is a first distance from the avatar; and determining, by the spatialized audio presentation system, a second delay parameter representative of a reflection time of a late echo of the sound, the late echo simulating a reflection of the sound from a surface that is a second distance from the avatar, the second distance greater than the first distance;

wherein the additional effect applied to the sound is a reverberation effect applied based on the first and second delay parameters.

5. The method of claim 1, further comprising:

determining, by the spatialized audio presentation system, a first diffusion parameter for a first echo of the sound, the first diffusion parameter determined based on a first material from which the first echo virtually reflects when propagating from the virtual sound source to the avatar; and determining, by the spatialized audio presentation system, a second diffusion parameter for a second echo of the sound, the second diffusion parameter determined based on a second material that is distinct from the first material and from which the second echo virtually reflects when propagating from the virtual sound source to the avatar;

wherein the additional effect applied to the sound is a reverberation effect applied based on the first and second diffusion parameters.

6. The method of claim 1, further comprising determining, by the spatialized audio presentation system, an occlusion parameter representative of an effect of a virtual occlusion object on the sound that is to be presented to the user, the virtual occlusion object obstructing a direct sound propagation path between the virtual sound source and the avatar; and wherein the additional effect applied to the sound is an occlusion effect applied based on the occlusion parameter.

7. The method of claim 1, further comprising:

identifying, by the spatialized audio presentation system, a distance from the virtual sound source to the avatar; and determining, by the spatialized audio presentation system based on the distance from the virtual sound source to the avatar, an attenuation parameter representative of an amplitude level fall-off of the sound propagating over the distance from the virtual sound source to the avatar;

wherein the additional effect is applied to the sound by applying, to the sound, the amplitude level fall-off represented by the attenuation parameter.

8. The method of claim 1, wherein:

the user is associated with the avatar during an augmented reality experience by acting as the avatar; and the sound virtually propagates from the virtual sound source to the user through an augmented reality space implemented as a physical real-world space surrounding the user during the augmented reality experience.

9. A system comprising:

a memory storing instructions; and a processor communicatively coupled to the memory and configured to execute the instructions to:

select, based on an orientation of an avatar with respect to a virtual sound source, a head-related impulse response from a library of head-related impulse responses corresponding to different potential orientations of the avatar with respect to the virtual sound source;

apply the selected head-related impulse response to a sound that is generated by the virtual sound source and is to be presented to a user associated with the avatar;

determine a source projection parameter indicative of an orientation of a cone of propagation corresponding to the sound and originating at the virtual sound source;

apply, based on the source projection parameter, a source projection effect to the sound, wherein:

the source projection effect is a first effect if the virtual sound source is facing the avatar such that the avatar is located within the cone of propagation, and the source projection effect is a second effect distinct from the first effect if the virtual sound source is facing away from the avatar such that the avatar is not located within the cone of propagation; and apply an additional effect to the sound that is to be presented to the user.

10. The system of claim 9, wherein:

the sound that is generated by the virtual sound source and is to be presented to the user is a voice communication spoken by an additional user associated with the virtual sound source and engaged in a virtual experience along with the user;

the virtual sound source that generates the sound to be presented to the user is a virtual avatar of the additional user; and the cone of propagation originates at a mouth of the virtual avatar of the additional user.

11. The system of claim 9, wherein:

the processor is further configured to execute the instructions to determine a delay parameter representative of a reflection time of an echo of the sound that is to be presented to the user, and determine a diffusion parameter for the echo based on a material from which the echo virtually reflects when propagating from the virtual sound source to the avatar; and the additional effect applied to the sound is a reverberation effect applied based on the delay parameter and the diffusion parameter.

12. The system of claim 9, wherein:

the processor is further configured to execute the instructions to determine a first delay parameter representative of a reflection time of an early echo of the sound that is to be presented to the user, the early echo simulating a reflection of the sound from a surface that is a first distance from the avatar, and determine a second delay parameter representative of a reflection time of a late echo of the sound, the late echo simulating a reflection of the sound from a surface that is a second distance from the avatar, the second distance greater than the first distance; and the additional effect applied to the sound is a reverberation effect applied based on the first and second delay parameters.

13. The system of claim 9, wherein:

the processor is further configured to execute the instructions to determine a first diffusion parameter for a first echo of the sound, the first diffusion parameter determined based on a first material from which the first echo virtually reflects when propagating from the virtual sound source to the avatar, and determine a second diffusion parameter for a second echo of the sound, the second diffusion parameter determined based on a second material that is distinct from the first material and from which the second echo virtually reflects when propagating from the virtual sound source to the avatar; and the additional effect applied to the sound is a reverberation effect applied based on the first and second diffusion parameters.

14. The system of claim 9, wherein:

the processor is further configured to execute the instructions to determine an occlusion parameter representative of an effect of a virtual occlusion object on the sound that is to be presented to the user, the virtual occlusion object obstructing a direct sound propagation path between the virtual sound source and the avatar; and the additional effect applied to the sound is an occlusion effect applied based on the occlusion parameter.

15. The system of claim 9, wherein:

the processor is further configured to execute the instructions to identify a distance from the virtual sound source to the avatar, and determine, based on the distance from the virtual sound source to the avatar, an attenuation parameter representative of an amplitude level fall-off of the sound propagating over the distance from the virtual sound source to the avatar; and the additional effect is applied to the sound by applying, to the sound, the amplitude level fall-off represented by the attenuation parameter.

16. The system of claim 9, wherein:

the user is associated with the avatar during an augmented reality experience by acting as the avatar; and the sound virtually propagates from the virtual sound source to the user through an augmented reality space implemented as a physical real-world space surrounding the user during the augmented reality experience.

17. A non-transitory computer-readable medium storing instructions that, when executed, direct a processor of a computing device to:

select, based on an orientation of an avatar with respect to a virtual sound source, a head-related impulse response from a library of head-related impulse responses corresponding to different potential orientations of the avatar with respect to the virtual sound source;

apply the selected head-related impulse response to a sound that is generated by the virtual sound source and is to be presented to a user associated with the avatar;

determine a source projection parameter indicative of an orientation of a cone of propagation corresponding to the sound and originating at the virtual sound source;

apply, based on the source projection parameter, a source projection effect to the sound, wherein:

the source projection effect is a first effect if the virtual sound source is facing the avatar such that the avatar is located within the cone of propagation, and the source projection effect is a second effect distinct from the first effect if the virtual sound source is facing away from the avatar such that the avatar is not located within the cone of propagation; and apply an additional effect to the sound that is to be presented to the user.

18. The non-transitory computer-readable medium of claim 17, wherein:

the sound that is generated by the virtual sound source and is to be presented to the user is a voice communication spoken by an additional user associated with the virtual sound source and engaged in a virtual experience along with the user;

the virtual sound source that generates the sound to be presented to the user is a virtual avatar of the additional user; and the cone of propagation originates at a mouth of the virtual avatar of the additional user.

19. The non-transitory computer-readable medium of claim 17, wherein:

the instructions further direct the processor to determine a delay parameter representative of a reflection time of an echo of the sound that is to be presented to the user, and determine a diffusion parameter for the echo based on a material from which the echo virtually reflects when propagating from the virtual sound source to the avatar; and the additional effect applied to the sound is a reverberation effect applied based on the delay parameter and the diffusion parameter.

20. The non-transitory computer-readable medium of claim 17, wherein:

the instructions further direct the processor to determine a first delay parameter representative of a reflection time of an early echo of the sound that is to be presented to the user, the early echo simulating a reflection of the sound from a surface that is a first distance from the avatar, and determine a second delay parameter representative of a reflection time of a late echo of the sound, the late echo simulating a reflection of the sound from a surface that is a second distance from the avatar, the second distance greater than the first distance; and the additional effect applied to the sound is a reverberation effect applied based on the first and second delay parameters.

* * * * *